US012031204B2

(12) United States Patent
Takazaki et al.

(10) Patent No.: US 12,031,204 B2
(45) Date of Patent: Jul. 9, 2024

(54) TITANIUM MEMBER, METHOD FOR MANUFACTURING TITANIUM MEMBER, AND DECORATIVE ARTICLE INCLUDING TITANIUM MEMBER

(71) Applicant: CITIZEN WATCH CO., LTD., Tokyo (JP)

(72) Inventors: Kotaro Takazaki, Sayama (JP); Masahiro Satoh, Iruma (JP)

(73) Assignee: CITIZEN WATCH CO., LTD., Tokyo (JP)

( * ) Notice: Subject to any disclaimer, the term of this patent is extended or adjusted under 35 U.S.C. 154(b) by 922 days.

(21) Appl. No.: 16/979,921

(22) PCT Filed: Mar. 13, 2019

(86) PCT No.: PCT/JP2019/010316

§ 371 (c)(1),
(2) Date: Sep. 11, 2020

(87) PCT Pub. No.: WO2019/177039

PCT Pub. Date: Sep. 19, 2019

(65) Prior Publication Data

US 2021/0010122 A1 Jan. 14, 2021

(30) Foreign Application Priority Data

Mar. 15, 2018 (JP) ..... 2018-048109

(51) Int. Cl.

| | |
|---|---|
| ***B32B 15/01*** | (2006.01) |
| ***A44C 27/00*** | (2006.01) |
| ***C22F 1/18*** | (2006.01) |

(52) U.S. Cl.
CPC ..... *C22F 1/183* (2013.01); *A44C 27/002* (2013.01); *Y10T 428/12993* (2015.01)

(58) Field of Classification Search
None
See application file for complete search history.

(56) References Cited

FOREIGN PATENT DOCUMENTS

| | | | |
|---|---|---|---|
| JP | 50-57908 | A | 5/1975 |
| JP | 50-120443 | A | 9/1975 |
| JP | 08-060336 | A | 3/1996 |

(Continued)

OTHER PUBLICATIONS

Extended European Search Report dated Oct. 18, 2021 in European Application No. 19766634.0.

(Continued)

*Primary Examiner* — Xiaobei Wang
(74) *Attorney, Agent, or Firm* — Sughrue Mion, PLLC

(57) ABSTRACT

A titanium member includes a first region where a plurality of first convex structural bodies extending in a first direction are arranged on the surface of the titanium member in a second direction orthogonal to the first direction, the first convex structural body has first convex portions arranged on an upper surface of the first convex structural body at an interval of several hundred nanometers along the first direction, and a height of the first convex portion is several ten nanometers. It is preferable that the first convex structural bodies adjacent in the second direction are arranged at an interval wider than the interval at which the first convex portions are arranged, and in the first convex structural bodies, a height including the first convex portion is higher than the height of the first convex portion.

17 Claims, 32 Drawing Sheets

(56) References Cited

FOREIGN PATENT DOCUMENTS

| | | | |
|---|---|---|---|
| JP | 8-92674 | A | 4/1996 |
| JP | 11-061366 | A | 3/1999 |
| JP | 2006-100150 | A | 4/2006 |
| JP | 2015-181077 | A | 10/2015 |

OTHER PUBLICATIONS

O'Hana et al., "Laser surface colouring of titanium for contemporary jewellery", Surface Engineering, 2008, vol. 24, No. 2, pp. 147-153 (8 pages total).
Kumar et al., "Thermal oxidation of Ti6Al4V alloy: Microstructural and electrochemical characterization", Materials Chemistry and Physics, 2010, vol. 119, pp. 337-346 (10 pages total).
Untracht Oppi, "Titanium direct heat treatment coloring", Jewelry Concepts and Technology, 1982, Doubleday, XP055849215 (6 pages total).
Antonczak et al., "The influence of process parameters on the laser-induced coloring of titanium", Appl Phys A, 2014, vol. 115, pp. 1003-1013 (11 pages total).
Kofstad et al., "High-Temperature Oxidation of Titanium", Journal of the Less-Common Metals, 1967, vol. 12, pp. 449-464 (16 pages total).
Office Action dated Oct. 18, 2022 in Japanese Application No. 2020-506614.
Office Action dated Jul. 23, 2021 in Chinese Application No. 201980018751.7.
Communication dated Jun. 8, 2022 from the Chinese Patent Office in Chinese Application No. 201980018751.7.
Communication dated Jan. 29, 2022 from the Chinese Patent Office in Chinese Application No. 201980018751.7.
International Search Report for PCT/JP2019/010316, dated Jun. 11, 2019.

TITANIUM MEMBER, METHOD FOR MANUFACTURING TITANIUM MEMBER, AND DECORATIVE ARTICLE INCLUDING TITANIUM MEMBER

CROSS REFERENCE TO RELATED APPLICATIONS

This application is a National Stage of Application No. PCT/JP2019/010316 filed Mar. 13, 2019, claiming priority based on Japanese Patent Application No. 2018-048109 filed Mar. 15, 2018.

FIELD

The present invention relates to a titanium member, a manufacturing method thereof, and a decorative article including the same.

BACKGROUND

Patent Literature 1 discloses a titanium alloy product having a mother-of-pearl inlay like texture. In the manufacturing of the titanium alloy product, a primary age hardening treatment, a crystal precipitation treatment, and a secondary age hardening treatment are performed. Specifically, in the primary age hardening treatment, a molded product of a titanium alloy is kept at the temperature of 350° C. to 600° C. for a certain period of time in air, vacuum, or inert gas atmosphere. In the crystal precipitation treatment, the molded product subjected to the primary age hardening treatment is heated at the temperature of 1000° C. to 1400° C. in a vacuum furnace, so that a titanium crystal is precipitated on the surface of the molded product. In the secondary age hardening treatment, the molded product subjected to the crystal precipitation treatment is kept at the temperature of 350° C. to 600° C. for a certain period of time in a process of leaving the molded product cooling in the air, vacuum, or inert gas atmosphere.

CITATION LIST

Patent Literature

Patent Literature 1: Japanese Patent Application Laid-open No. H11-61366

SUMMARY

Technical Problem

However, the titanium alloy product does not exhibit a blue color with excellent decorativeness.

In this regard, an object of the present invention is to provide a titanium member that exhibits a blue color with excellent decorativeness.

Solution to Problem

A titanium member according to the present invention is the titanium member that has a titanium content of 99 mass % or more, and the titanium member includes a first region where a plurality of first convex structural bodies extending in a first direction are arranged on a surface of the titanium member in a second direction orthogonal to the first direction, wherein the first convex structural body has first convex portions arranged on an upper surface of the first convex structural body at an interval of several hundred nanometers along the first direction, and a height of the first convex portion is several ten nanometers.

Advantageous Effects of Invention

The titanium member of the present invention exhibits a blue color with excellent decorativeness.

DESCRIPTION OF EMBODIMENTS

Figure 1:
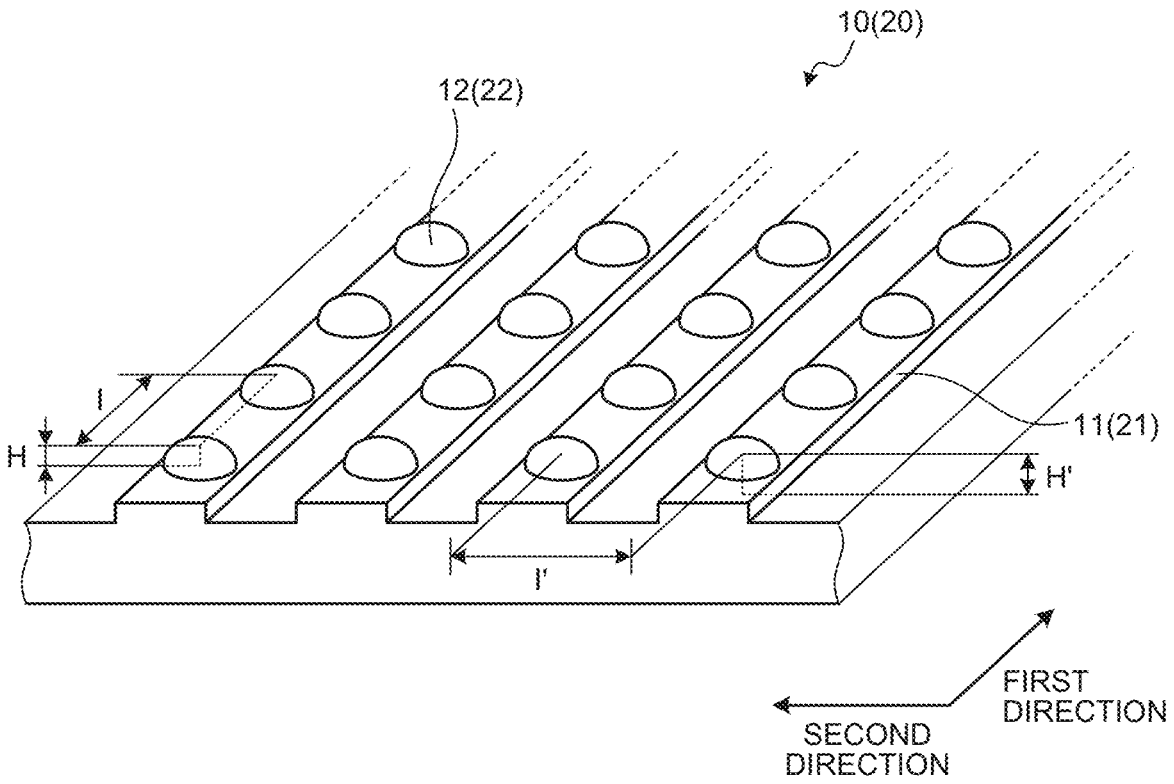
FIG. 1 is a diagram for explaining a surface structure of a titanium member.

Hereinafter, modes (embodiments) for carrying out the present invention will be described in detail. Note that the present invention is not limited by the content described in the following embodiments. Furthermore, the components described below include those that can be easily assumed by a person skilled in the art and those that are substantially the same. Moreover, the configurations described below can be appropriately combined. Furthermore, various omissions, substitutions, or modifications in the configurations can be made without departing from the scope of the present invention.

<Titanium Member>

A titanium member of embodiments has a first region where a plurality of first convex structural bodies extending in a first direction are arranged on the surface of the titanium member in a second direction orthogonal to the first direction, in which the first convex structural body has first convex portions arranged on the upper surface of the first convex structural body at an interval of several hundred nanometers along the first direction, and the height of the first convex portion is several ten nanometers. More specifically, a first embodiment and a second embodiment will be described below.

First Embodiment

A titanium member according to the first embodiment has a titanium content of 99 mass % or more. When the titanium content is in the above range, a light and low-cost member is obtained. The residual part is carbon, oxygen, nitrogen, hydrogen, iron, and the like. The type of elements included in the titanium member can be examined by an energy dispersive X-ray spectroscopy (EDX). Furthermore, oxygen is usually included as titanium oxide. Specifically, as a raw material of the titanium member, industrial pure titanium corresponding to JIS Class 1, JIS Class 2, JIS Class 3, or JIS Class 4 can be used.

The titanium member has a plate sharp and its upper surface (main surface) is covered with small pieces of a first region, a second region, and a third region. The small pieces of the first region, the second region, and the third region are arranged in a mosaic pattern. The first region exhibits a blue color, the second region exhibits a white color, and the third region exhibits other colors (colors other than the blue color and the white color) such as a gray color and a black color. The blue color of the first region and the white color of the second region are excellent in decorativeness. In the present specification, "excellent in decorativeness" refers to a beautiful and shining appearance with glitter and like mother-of-pearl inlay. The first region, the second region, and the third region will be described below.

[First Region]

The titanium member has the first region on the surface thereof. The first region is measured by an atomic force microscope (AFM) in conformity with JISB0601 and JISR1683, and in a cross-sectional profile obtained by cutting a measurement result of the first region in the first direction, elements corresponding to the first convex portions arranged on the upper surface of the first convex structural body (which will be described below) along the first direction have a length of several hundred nanometers and a height of several ten nanometers. Preferably, the length of the elements is in the range of 300 nm or more and 500 nm or less and the height of the elements is in the range of 40 nm or more and 70 nm or less. Specifically, first, a swell component is removed from a measured cross-sectional curve of an actual surface by applying a phase compensation filter of a cutoff value λs. Then, a maximum height (highest peak height+deepest valley depth) and a minimum height (lowest peak height+shallowest valley depth) are measured. From these values, the height range of the elements is obtained. Furthermore, a maximum length and a minimum length of one contour element length are measured. From these values, the length range of the elements is obtained. The first direction is a direction along thin lines, which are regularly drawn, which is observed by a microscope mounted on a scanning probe microscope (atomic force microscope (AFM)). Consequently, in a plurality of first regions existing on the surface, respective actual first directions are usually different. Measurement conditions by the AFM will be described below in examples.

That is, it is considered that the measurement result of the AFM corresponds to the fact that the surface of the titanium member includes the first region having the following specific structure. FIG. 1 is a diagram for explaining the surface structure of the titanium member. In a first region 10 of the titanium member, a plurality of first convex structural bodies 11 extending in the first direction are arranged in the second direction orthogonal to the first direction. The first convex structural body 11 has first convex portions 12 (corresponding to the aforementioned elements) arranged on the upper surface the first convex structural body 11 at an interval I of several hundred nanometers (preferably, 300 nm or more and 500 nm or less) along the first direction. A height H of the first convex portion 12 is several ten nanometers (preferably, 40 nm or more and 70 nm or less).

Furthermore, the first region is measured by the AFM as described above, and in the cross-sectional profile obtained by cutting the measurement result of the first region in the second direction orthogonal to the first direction, the length of the elements is larger than that of the elements in the cross-sectional profile obtained by cutting the measurement result of the first region in the first direction. Furthermore, the height of the elements is larger than that of the elements in the cross-sectional profile obtained by cutting the measurement result of the first region in the first direction. Preferably, the length of the elements is in the range of 650 nm or more and 780 nm or less and the height of the elements is in the range of 75 nm or more and 120 nm or less. The length of the elements and the height of the elements are obtained in the same manner as in the case of the cross-sectional profile obtained by cutting the measurement result of the first region in the first direction.

That is, it is considered that the measurement result of the AFM corresponds to the fact that the first region further has the following specific structure. The first convex structural bodies 11 adjacent in the second direction are arranged at an interval I' (preferably, an interval I' of 650 nm or more and 780 nm or less) wider than the interval at which the first convex portions 12 are arranged. In the first convex structural bodies 11, a height H' including the height of the first convex portions 12 is higher than the height H of the first convex portions 12 (preferably, 75 nm or more and 120 nm or less).

Since the first region exhibits the aforementioned cross-sectional profile along the first direction (that is, with the aforementioned specific structure along the first direction), the first region is considered to exhibit a blue color with excellent decorativeness. Furthermore, the fact that the first region exhibits the aforementioned cross-sectional profile along the second direction (that is, further with the aforementioned specific structure along the second direction) is also considered to be related to the blue color development.

The lengths (intervals I and I') of the elements and the heights (heights H and H') of the elements extend over a specific numerical range as described above. Furthermore, in the aforementioned cross-sectional profile along the first direction and the second direction, waves having a large period are usually observed. As described above, the first region has randomness in both a planar direction in which the first region extends and a height direction perpendicular to the planar direction. Therefore, it is considered that iridescent interference generally occurring in a diffraction grating due to light interference between irregularities is suppressed. In this way, it is considered that the titanium member exhibits a blue color with excellent decorativeness.

In FIG. 1, the first convex structural body 11 is represented as a rectangular parallelepiped and the first convex portion 12 is represented as a part of a crushed sphere. However, these are merely schematic representations. The shapes of the first convex structural body 11 and the first convex portion 12 are not limited thereto.

The first region usually includes a crystal structure preferentially oriented in (102), (110), and (103) planes belonging to an α phase, which is a hexagonal close-packed crystal, or has the crystal structure preferentially oriented in the (102), (110), and (103) planes belonging to the α phase, which is a hexagonal close-packed crystal, and a crystal structure preferentially oriented in a (200) plane belonging to a β phase, which is a body-centered cubic crystal, and in any case, has a crystal structure strongly preferentially oriented in the (103) plane. These crystal structures can be examined by an X-ray diffraction method. A measurement method of the X-ray diffraction method will be described in detail in examples.

Furthermore, the first region usually includes a small amount of carbon and oxygen. The type of elements included in the first region can be examined by the EDX. A measurement method of the EDX will be described in detail in examples.

Furthermore, the first region exhibits a blue color as described above. In the present specification, the blue color refers to a color in, for example, a case where the following conditions are satisfied in RGB measurement values. In other words, when the R value, the G value, and the B value are measured for the first region, the conditions are usually satisfied. A measurement method of the R value, the G value, and the B value will be described in detail in examples.

Blue color condition: Difference between the R value and the G value is within 30, and the B value is larger than the R value by 70 or more and is larger than the G value by 70 or more. Each of the R value, the G value, and the B value is an integer of 0 or more and 255 or less.

Moreover, the fact that the first region exhibits a blue color can be confirmed by performing reflectance measurement. That is, when performing the reflectance measurement, the reflectance of a wavelength (usually, 340 to 500 nm) indicating a blue color is high in the first region.

Furthermore, the size of the first region is preferably 100 μm or more and 2500 μm or less. A measurement method of the size of the region will be described in detail in examples. The shape of the first region is, for example, a polygon. The first region may have a shape in which at least some of the sides of the polygon are curved.

[Second Region]

The titanium member further has the second region on the titanium member. The second region is measured by the AFM in conformity with JISB0601 and JISR1683, and in a cross-sectional profile obtained by cutting a measurement result of the second region in the first direction, the length of elements corresponding to second convex portions arranged on the upper surface of a second convex structural body (which will be described below) along the first direction is smaller than that of the elements in the cross-sectional profile obtained by cutting the measurement result of the first region in the first direction. Furthermore, the height of the elements is smaller than that of the elements in the cross-sectional profile obtained by cutting the measurement result of the first region in the first direction. Preferably, the length of the elements is in the range of 100 nm or more and 200 nm or less and the height of the elements is in the range of 5 nm or more and 13 nm or less. Specifically, first, a swell component is removed from a measured cross-sectional curve of an actual surface by applying a phase compensation filter of a cutoff value λs. Then, a maximum height (highest peak height+deepest valley depth) and a minimum height (lowest peak height+shallowest valley depth) are measured. From these values, the height range of the elements is obtained. Furthermore, a maximum length and a minimum length of one contour element length are measured. From these values, the length range of the elements is obtained. The first direction is the direction along the thin lines, which are regularly drawn, which is observed by the microscope mounted on the scanning probe microscope (atomic force microscope (AFM)). Consequently, in a plurality of second regions existing on the surface, respective actual first directions are usually different. Measurement conditions by the AFM will be described in detail in examples.

That is, it is considered that the measurement result of the AFM corresponds to the fact that the surface of the titanium member includes the second region having the following specific structure. FIG. 1 is a diagram for explaining the surface structure of the titanium member. In a second region 20 of the titanium member, a plurality of second convex structural bodies 21 extending in the first direction are arranged in the second direction orthogonal to the first direction. The second convex structural body 21 has second convex portions 22 arranged on the upper surface of the second convex structural body 21 at an interval I (preferably, an interval I of 100 nm or more and 200 nm or less) that is narrower than the interval at which the first convex portions 12 are arranged, along the first direction. A height H (preferably, 5 nm or more and 13 nm or less) of the second convex portion is lower than that of the first convex portion.

Furthermore, the second region is measured by the AFM as described above, and in the cross-sectional profile obtained by cutting the measurement result of the second region in the second direction orthogonal to the first direction, the length of the elements is in the range of several hundred nanometers or more and several thousand nanometers or less (preferably, 820 nm or more and 1100 nm or less) and the height of the elements is in the range of several ten nanometers or more and several hundred nanometers or less (preferably, 70 nm or more and 120 nm or less). The length of the elements and the height of the elements are obtained in the same manner as in the case of the cross-sectional profile obtained by cutting the measurement result of the second region in the first direction.

That is, it is considered that the measurement result of the AFM corresponds to the fact that the second region further has the following specific structure. The second convex structural bodies 21 adjacent in the second direction are arranged at an interval I' of several hundred nanometers or more and several thousand nanometers or less (preferably, 820 nm or more and 1100 nm or less). In the second convex structural bodies 21, a height H' including the height of the second convex portions 22 is several ten nanometers or more and several hundred nanometers or less (preferably, 75 nm or more and 120 nm or less).

Since the second region exhibits the aforementioned cross-sectional profile along the first direction (that is, with the aforementioned specific structure along the first direction), the second region is considered to exhibit a white color with excellent decorativeness.

In FIG. 1, the second convex structural body 21 is represented as a rectangular parallelepiped and the second convex portion 22 is represented as a part of a crushed sphere. However, these are merely schematic representations. The shapes of the second convex structural body 21 and the second convex portion 22 are not limited thereto.

The second region usually includes a crystal structure preferentially oriented in (102), (110), and (103) planes belonging to an α phase, which is a hexagonal close-packed crystal, or has the crystal structure preferentially oriented in the (102), (110), and (103) planes belonging to the α phase, which is a hexagonal close-packed crystal, and a crystal structure preferentially oriented in a (200) plane belonging to a β phase, which is a body-centered cubic crystal. These crystal structures can be examined by an X-ray diffraction method. A measurement method of the X-ray diffraction method will be described in detail in examples.

Furthermore, the second region exhibits a white color as described above. In the present specification, the white color refers to a color in, for example, a case where the following conditions are satisfied in RGB measurement values. In other words, when the R value, the G value, and the B value are measured for the second region, the conditions are usually satisfied. A measurement method of the R value, the G value, and the B value will be described in detail in examples.

White color condition: Each of the R value, the G value, and the B value is 170 or more, the difference between the R value and the G value is within 50, the difference between the G value and the B value is within 50, and the difference between the B value and the R value is within 50. Each of the R value, the G value, and the B value is an integer of 0 or more and 255 or less.

Furthermore, preferably, the size of the second region is approximately the same as that of the first region. A measurement method of the size of the region will be described in detail in examples. The shape of the second region is, for example, a polygon. The second region may have a shape in which at least some of the sides of the polygon are curved.

[Third Region]

The titanium member further has the third region on the titanium member. The third region has an approximately flat surface structure. The third region can be confirmed by performing measurement in conformity with JISB0601 and JISR1683. Measurement conditions by the AFM will be described in examples. Furthermore, since the third region has the surface structure, the third region exhibits other colors (colors other than a blue color and a white color) such as a gray color and a black color. In the present specification, the other colors may be collectively referred to as a black color.

The third region usually includes a crystal structure preferentially oriented in (102), (110), and (103) planes belonging to an α phase, which is a hexagonal close-packed crystal. This crystal structure can be examined by an X-ray diffraction method. A measurement method of the X-ray diffraction method will be described in detail in examples.

Furthermore, the third region usually includes a small amount of carbon and oxygen. The type of elements included in the third region can be examined by the EDX. A measurement method of the EDX will be described in detail in examples.

Furthermore, the third region exhibits the other colors such as a gray color and a black color as described above. Consequently, when the R value, the G value, and the B value are measured for the third region, the aforementioned blue color condition and the aforementioned white color condition are not usually satisfied. A measurement method of the R value, the G value, and the B value will be described in detail in examples.

Furthermore, preferably, the size of the third region is approximately the same as that of the first region. A measurement method of the size of the region will be described in detail in examples. The shape of the third region is, for example, a polygon. The third region may have a shape in which at least some of the sides of the polygon are curved.

On the upper surface (main surface) of the titanium member, the ratio of the areas of the first region, the second region, and the third region is not particularly limited. For example, when the total area of the first region, the second region, and the third region is set to 100%, the area ratio of the first region is 1% or more and 48% or less, the area ratio of the second region is 1% or more and 48% or less, and the area ratio of the third region is 4% or more and 98% or less.

Hereinafter, the principle of the color development of the titanium member will be described in more detail. First, the principle that the first region develops a blue color will be described. In the first region, irregularities (a concave/convex structure) having a specific height (for example, 40 to 70 nm) are regularly arranged at a specific pitch (for example, 300 to 500 nm) by the AFM measurement. It is presumed that the irregular structure (the concave/convex structure) and the pitch interval are factors that strongly reflect a blue color.

The pitch of the irregular structure is approximately the same as the wavelength of blue light. According to the Huygens' principle, since light with a longer wavelength than the pitch does not cause diffraction, blue reflection is relatively strong. The color development of the titanium member is based on the principle of the diffraction grating described above. When an incident angle of light (white light) increases, since the irregular structure is regarded as a flat surface for light, blue reflection decreases.

Furthermore, since the width of one irregularity is smaller than the wavelength of light, diffraction spread occurs, so that it looks blue in a wide angle range.

Furthermore, since the arrangement of the irregularities includes randomness in both the height direction and the planar direction, iridescent interference generally occurring in the diffraction grating due to light interference between irregularities does not occur.

Next, the principle that the second region develops a white color will be described. In the second region, irregularities having a specific height (for example, 5 to 13 nm) are regularly arranged at a specific pitch (for example, 100 to 200 nm) by the AFM measurement. Therefore, the pitch of the irregular structure is shorter than the wavelength (380 to 780 nm) of visible light. Therefore, it is considered that no diffraction occurs in an entire visible light region and diffused reflection occurs. Due to the diffused reflection, a higher reflection than a reflectance based on an intrinsic refractive index and an extinction coefficient of titanium is obtained, and it looks white and shiny. It is presumed that the high reflectance of white is obtained due to the diffused reflection in the entire visible light region.

Furthermore, the formation of the surface structure (fine structure) of the titanium member will be described in more detail. It is presumed that a fine structure (structure in which irregularities having a specific height are arranged at a specific pitch), in which a blue color is relatively strongly reflected, is formed during the phase transition of titanium from an α phase to a β phase. Pure titanium has an α phase at room temperature and has a dense hexagonal close-packed structure (HCP). Above 880° C., the titanium is subjected to a phase transition to a β phase and a face-centered cubic lattice structure (FCC). When the pure titanium is heated to above the phase transition temperature, a metal crystal slides from the dense hexagonal close-packed structure (HCP) to the face-centered cubic lattice structure (FCC) during temperature increase, so that needle-like crystals grow. It is presumed that a fine structure, in which a blue color is relatively strongly reflected, is formed by this sliding process. Therefore, even though the pure titanium is simply heated above the phase transition temperature, it is difficult to obtain the fine structure as described above. A method for forming the fine structure will be described later.

The white crystal (second region) is generated when the blue crystal (first region) further absorbs heat and grows. A fine structure (structure in which irregularities having a specific height are regularly arranged at a specific pitch), in which a white color is strongly reflected, is not observable unless a blue crystal phase is first formed. Furthermore, when the white crystal phase further grows, it is presumed that a phase transition to a complete β phase is made to achieve a black crystal (third region). Note that the black crystal is a low-reflection region and exhibits the original color of titanium.

The titanium member according to the aforementioned first embodiment has the first region, the second region, and the third region; however, the present invention is not limited thereto. It is sufficient if the titanium member has at least the first region. For example, the titanium member may have only the first region, may have only the first region and the second region, or may have only the first region and the third region.

Furthermore, in the first region of the titanium member according to the aforementioned first embodiment, in the cross-sectional profile obtained by cutting the measurement result of the first region in the second direction orthogonal to the first direction, the length of the elements and the height of the elements are within a specific numerical range. That is, the interval I' and the height H' are within the specific numerical range. However, the numerical range of the length of the elements and the height of the elements may be different from the aforementioned numerical range. That is, the numerical range of the interval I' and the height H' may be different from the aforementioned numerical range. In other words, it is sufficient if these numerical ranges are in the range in which a blue color is exhibited.

Furthermore, in the second region of the titanium member according to the aforementioned first embodiment, in the cross-sectional profile obtained by cutting the measurement result of the second region in the second direction orthogonal to the first direction, the length of the elements and the height of the elements are within a specific numerical range. That is, the interval I' and the height H' are within the specific numerical range. However, the numerical range of the length of the elements and the height of the elements may be different from the aforementioned numerical range. That is, the numerical range of the interval I' and the height H' may be different from the aforementioned numerical range. In other words, it is sufficient if these numerical ranges are in the range in which a white color is exhibited.

Second Embodiment

Regarding a titanium member according to the second embodiment, description of the same points as that of the titanium member according to the first embodiment will be omitted and different points will be described below.

The titanium member according to the second embodiment includes a β alloy or an α+β alloy.

When the titanium member includes the β alloy or the α+β alloy, the first region usually includes a crystal structure preferentially oriented in a (200) plane belonging to a β phase, which is a body-centered cubic crystal.

On the upper surface (main surface) of the titanium member, the ratio of the areas of the first region, the second region, and the third region is not particularly limited. For example, when the total area of the first region, the second region, and the third region is set to 100%, the area ratio of the first region is 1% or more and 62% or less, the area ratio of the second region is 1% or more and 48% or less, and the area ratio of the third region is 4% or more and 68% or less.

<Manufacturing Method of Titanium Member>

The manufacturing method of a titanium member according to embodiments is a manufacturing method of a titanium member that has a first region where a plurality of first convex structural bodies extending in a first direction are arranged on the surface of the titanium member in a second direction orthogonal to the first direction, in which the first convex structural body has first convex portions arranged on the upper surface the first convex structural body at an interval of several hundred nanometers along the first direction, and the height of the first convex portion is several ten nanometers. The manufacturing method of the titanium member according to the embodiments includes, for example, a first heating step of heating a raw material titanium member under reduced pressure by increasing temperature from room temperature to temperature T1 of 730° C. or more to 950° C. or less, a second heating step of heating the raw material titanium member that has been subjected to the first heating step, under reduced pressure by increasing temperature from the temperature T1 to temperature T2 of 900° C. or more to 1150° C. or less that is higher than the temperature T1, over 0.5 hours or more and 8 hours or less, and a cooling step of cooling the raw material titanium member that has been subjected to the second heating step by decreasing temperature from the temperature T2 to temperature lower than the temperature T2 and obtaining the titanium member. More specifically, the manufacturing method of the titanium member according to the embodiments includes a manufacturing method of manufacturing the titanium member according to the aforementioned first embodiment (manufacturing method of the first embodiment) and a manufacturing method of manufacturing the titanium member according to the aforementioned second embodiment (manufacturing method of the second embodiment). Hereinafter, the manufacturing method of the first embodiment and the manufacturing method of the second embodiment will be described.

[Manufacturing Method of First Embodiment]

The manufacturing method of the titanium member according to the aforementioned first embodiment includes a first heating step, a second heating step, and a cooling step.

Figure 2:
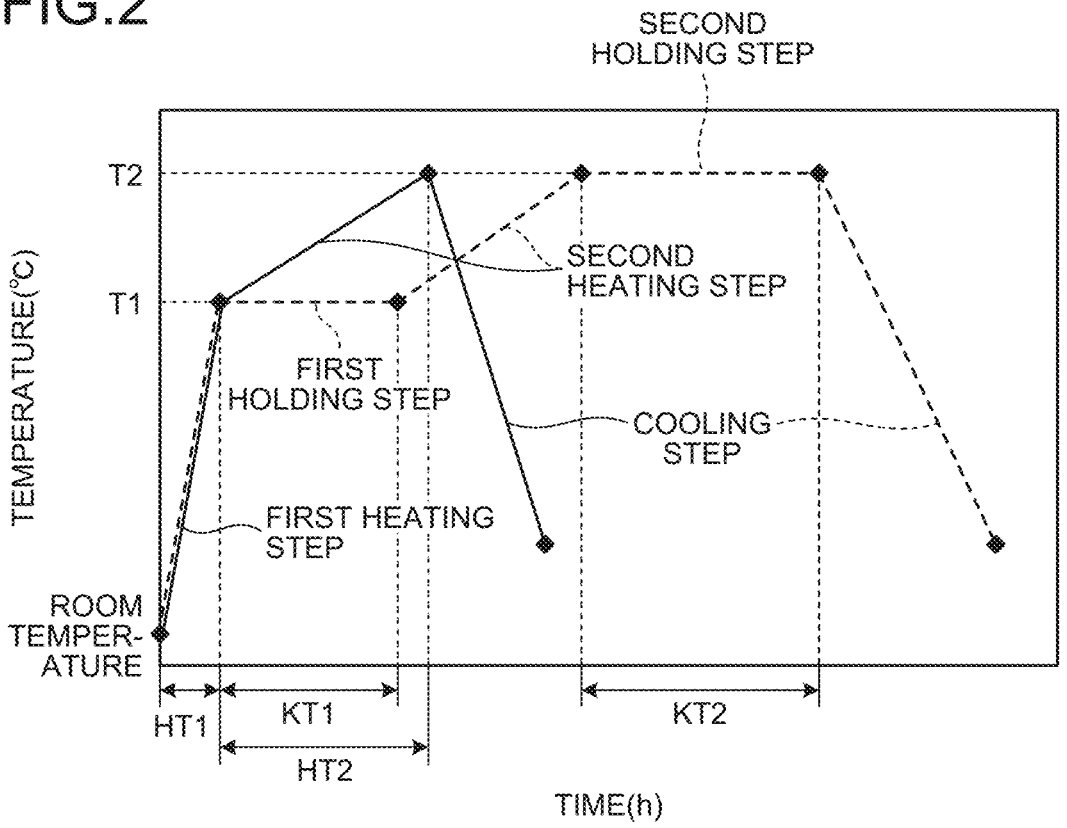
FIG. 2 is a diagram for explaining a manufacturing method of the titanium member.

FIG. 2 is a diagram for explaining the manufacturing method of the titanium member. Specifically, temperature is controlled as indicated by the solid line. In the first heating step, a raw material titanium member that has a titanium content of 99 mass % or more is heated under reduced pressure by increasing temperature from room temperature (for example, 10° C. or more to 30° C. or less) to temperature T1 of 800° C. or more to 950° C. or less. As described above, the temperature T1 (temperature increasing start temperature, first arrival temperature) is preferably 800° C. or more to 950° C. or less at which a phase transition from an α phase to a β phase occurs. When the temperature T1 is less than 800° C., there may be no effect on crystal growth. Furthermore, when the temperature T1 exceeds 950° C., the amounts of blue crystals and white crystals tend to decrease. The raw material titanium member has a plate shape. When the content of titanium is in the above range, a light and low-cost member is obtained. The residual part is carbon, oxygen, nitrogen, hydrogen, iron, and the like. The type of elements included in the raw material titanium member can be examined by the EDX. Furthermore, oxygen is usually included as titanium oxide. Specifically, as the raw material titanium member, industrial pure titanium corresponding to JIS Class 1, JIS Class 2, JIS Class 3, or JIS Class 4 can be used.

Furthermore, the first heating step is performed under reduced pressure and pressure is preferably $8.0\times10^{-3}$ Pa or less.

In the second heating step, the raw material titanium member that has been subjected to the first heating step is heated under reduced pressure by increasing temperature from the temperature T1 to temperature T2 of 950° C. or more to 1150° C. or less that is higher than the temperature T1, over 0.5 hours or more and 15 hours or less, preferably, 0.5 hours or more and 8 hours or less. As described above, the temperature T2 (second arrival temperature) is an important condition for controlling the size of the blue crystal and is preferably 950° C. or more to 1150° C. or less. When it is desired to decrease the size of the blue crystal, the temperature T2 is preferably set to around 950° C., and when it is desired to increase the sizes of the blue crystal and the white crystal, the temperature T2 is preferably set to around 1150° C. When the temperature is lower than 950° C., the overall size of crystal may become too small. Furthermore, when the temperature is higher than 1150° C., since the crystal may grow excessively and expand, both the blue crystal and the white crystal may disappear. That is, a black crystal, which is a low-reflection region and exhibits the original color of titanium, may be formed.

Furthermore, the second heating step is performed under reduced pressure and pressure is preferably $8.0\times10^{-3}$ Pa or less.

Furthermore, heating time HT1 (first temperature increasing time) in the first heating step is specifically time required to reach the temperature T1 from room temperature, and, for example, 1 hour or more and 3 hours or less. Heating time HT2 (second temperature increasing time) in the second heating step is specifically time required to reach the temperature T2 from the temperature T1, and, for example, 0.5 hours or more and 15 hours or less, preferably, 0.5 hours or more and 8 hours or less. The heating time HT2 is the most important condition for producing the blue crystal and the white crystal. When the heating time HT2 is too short, since sliding due to a phase transition occurs abruptly, it is difficult to form a fine irregular structure. Furthermore, even though the heating time HT2 exceeds 8 hours, there is no significant difference in obtained crystals.

Specifically, a temperature increasing rate S2 in the second heating step is lower than a temperature increasing rate S1 in the first heating step. Note that the temperature increasing rate S1 (° C./hour) is calculated by (temperature T1−room temperature)/heating time HT1, and the temperature increasing rate S2 (° C./hour) is calculated by (temperature T2−temperature T1)/heating time HT2. When the temperature increasing rate S2 is too high, since sliding due to a phase transition occurs abruptly, it is difficult to form a fine irregular structure.

In the cooling step, the raw material titanium member that has been subjected to the second heating step is cooled by decreasing temperature from the temperature T2 to temperature lower than the temperature T2. The raw material titanium member is preferably cooled up to temperature of room temperature or more to 150° C. or less, for example, 150° C. By so doing, the aforementioned titanium member is obtained. The cooling rate in the cooling step is a condition for allowing the crystal transitioned to the β phase to return to the α phase, and is preferably as low as possible. Even though the raw material titanium member is slowly or rapidly cooled, there is no significant change in the form of the blue crystal and the white crystal. However, in the case of the rapid cooling, a serrated structure may appear at the crystal interface. Even though such a structure is formed, there is almost no change in mechanical properties, but ductility may decrease.

Furthermore, the cooling step is performed under atmospheric pressure or reduced pressure. When the cooling step is performed under reduced pressure, pressure is preferably $8.0\times10^{-3}$ Pa or less.

Note that the manufacturing method of the titanium member may include a first heating step of heating a raw material titanium member that has a titanium content of 99 mass % or more, under reduced pressure from room temperature to temperature T1 of 800° C. or more to 950° C. or less, a second heating step of heating the raw material titanium member that has been subjected to the first heating step from the temperature T1 to temperature T2 higher than 1150° C. and 1200° C. or lower over 0.5 hours or more and less than 5 hours, and a cooling step of cooling the raw material titanium member that has been subjected to the second heating step by decreasing temperature from the temperature T2 to temperature lower than the temperature T2 and obtaining the titanium member.

Even when the temperature T2 is high, it is possible to provide a titanium member exhibiting a blue color by adjusting the heating time HT2 to be short.

The manufacturing method of the titanium member according to the aforementioned first embodiment includes the first heating step, the second heating step, and the cooling step. However, the manufacturing method of the titanium member may further include a first holding step of holding the raw material titanium member that has been subjected to the first heating step, under reduced pressure at the temperature T1 for 0.5 hours or more and 3 hours or less, and a second holding step of holding the raw material titanium member that has been subjected to the second heating step, under reduced pressure at the temperature T2 for 0.5 hours or more and 6 hours or less. In such a case, in the second heating step, the raw material titanium member that has been subjected to the first holding step is heated. Furthermore, in the cooling step, the raw material titanium member that has been subjected to the second holding step is cooled to obtain the titanium member. Specifically, the temperature may be controlled as indicated by the broken line in FIG. 2.

Holding time KT2 (second holding time) in the second holding step is a condition that can control the sizes and the relative ratio of the blue crystal and the white crystal and the surface state of the entire surface. When the holding time is increased, the blue crystal changes to the white crystal, and the ratio of the white crystal tends to increase as the holding time is increased. When the holding time is further increased, a phase transition from the white crystal to the black crystal (β titanium) tends to occur. That is, there is a tendency that the original reflection color of titanium is exhibited. Furthermore, holding time KT1 (first holding time) in the first holding step can also be appropriately adjusted to increase the amount of the blue crystals.

Furthermore, the first holding step and the second holding step are performed under reduced pressure and pressure is preferably $8.0\times10^{-3}$ Pa or less.

The manufacturing method of the titanium member according to the aforementioned first embodiment may be a manufacturing method including either of the first holding step or the second holding step.

As described above, the amounts of the blue crystals and the white crystals can be controlled by the balance between the temperature increasing rate S2 and the temperature T2 (second arrival temperature). For example, when the heating time HT2 is increased (the temperature increasing rate S2 is small), it is preferable to shorten the holding time KT2 in the second holding step. As described above, it is preferable to appropriately set the condition depending on a crystal ratio to be obtained.

The manufacturing method of the titanium member according to the aforementioned first embodiment may alternatively be the following manufacturing method. A description of the same conditions as in the aforementioned manufacturing method will be omitted. When such manufacturing method is employed, it is also possible to provide a titanium member that exhibits a blue color.

Figure 3:
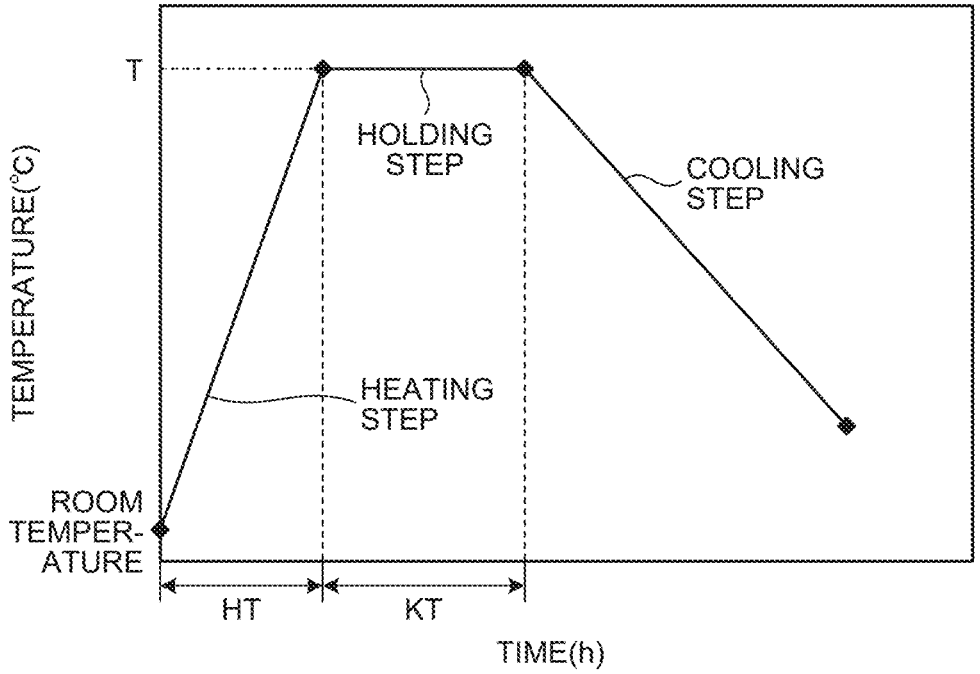
FIG. 3 is a diagram for explaining the manufacturing method of the titanium member.

The manufacturing method of the aforementioned titanium member may include a heating step, a holding step, and a cooling step. FIG. 3 is a diagram for explaining the manufacturing method of the titanium member. Specifically, temperature is controlled as indicated by the solid line. In the heating step, a raw material titanium member that has a titanium content of 99 mass % or more is heated under reduced pressure from room temperature to temperature T of 900° C. or more to 1050° C. or less. In the holding step, the raw material titanium member that has been subjected to the heating step is held under reduced pressure at the temperature T for 1 hour or more and 8 hours or less. In the cooling step, the raw material titanium member that has been subjected to the holding step is cooled by decreasing temperature from the temperature T to temperature lower than the temperature T. The raw material titanium member is preferably cooled up to temperature of room temperature or more to 150° C. or less, for example, 150° C. By so doing, the aforementioned titanium member is obtained.

Note that the manufacturing method of the titanium member may include a first heating step of heating a raw material titanium member that has a titanium content of 99 mass % or more, under reduced pressure from room temperature to temperature T higher than 1050° C. and 1100° C. or lower, and a first holding step of holding the raw material titanium member that has been subjected to the first heating step, under reduced pressure at the temperature T for 1 hour or more and less than 3 hours.

Even when the temperature T is high, it is possible to provide a titanium member exhibiting a blue color by adjusting the holding time to be short.

The conditions such as the arrival temperature, the heating time, and the holding time described above are an example for producing a fine structure that relatively strongly reflects a blue color or a fine structure that strongly reflects a white color. For example, the section from the first arrival temperature to the second arrival temperature is not a straight line, and may be what is called a jagged temperature increasing pattern in which the second arrival temperature is reached while temperature repeatedly increases and decreases. Furthermore, the second arrival temperature may be, for example, a pattern in which temperature increases to 1050° C. and then decreases to 850° C., and is held.

That is, the aforementioned manufacturing method of the titanium member may include a first heating step of heating a raw material titanium member that has a titanium content of 99 mass % or more, under reduced pressure by increasing temperature from room temperature to 850° C., and a second heating step of heating the raw material titanium member that has been subjected to the first heating step, by repeatedly increasing and decreasing temperature in the temperature range of 850° C. or more to 1100° C. or less. Preferably, a temperature increasing rate and a temperature decreasing rate in the second heating step are smaller than a temperature increasing rate in the first heating step. In the second heating step, a holding time above 1050° C. is preferably less than 3 hours.

[Manufacturing Method of Second Embodiment]

Regarding the manufacturing method of the titanium member according to the second embodiment, description of the same points as that of the manufacturing method of the titanium member according to the first embodiment will be omitted and different points will be described below.

In the manufacturing method of the second embodiment, a raw material titanium member including a β alloy or an α+β alloy is used as the raw material titanium member. Furthermore, in a first heating step, temperature T1 is 730°

C. or more to 950° C. or less, and in a second heating step, temperature T2 is larger than the temperature T1 and is 900° C. or more to 1150° C. or less. As described above, the lower limits of the temperature T1 and the temperature T2 are lower than those in the manufacturing method of the first embodiment. This is because the raw material titanium member includes the β alloy or the α+β alloy and these have a lower transition temperature than the raw material titanium member used in the manufacturing method of the first embodiment.

Also in the manufacturing method of the second embodiment, similarly to the manufacturing method of the first embodiment, for example, the section from the first arrival temperature (temperature T1) to the second arrival temperature (temperature T2) is not a straight line, and may be what is called a jagged temperature increasing pattern in which the second arrival temperature (temperature T2) is reached by repeatedly increasing and decreasing temperature. In such a case, in the manufacturing method of the second embodiment, the aforementioned manufacturing method of the titanium member may further include a first heating step of heating the raw material titanium member under reduced pressure by increasing temperature from room temperature to the temperature T1 of 730° C. or more to 950° C. or less and a second heating step of heating the raw material titanium member that has been subjected to the first heating step, to the temperature T2 by repeatedly increasing and decreasing temperature in the temperature range of 730° C. or more to 1100° C. or less.

The titanium member according to the aforementioned embodiment has a plate sharp and has a first region on its upper surface (main surface). However, the titanium member may have, for example, other shapes such as a rod shape, a polyhedron shape, a cylindrical shape, and a spherical shape. Furthermore, it is sufficient if the titanium member has the first region on least a part of the surface of the titanium member.

The titanium member according to the aforementioned embodiment may further have a coating on the surface having the first region. Examples of the coating include a white noble metal film such as Pt, Pd, and Rh having high brightness, a metal nitride film such as TiN, ZrN, and HfN exhibiting a gold color, a metal carbonitride film and a metal oxynitride film such as TiCN, ZrCN, HfCN, TiON, ZrON, and HfON exhibiting a pink color to a brown color, a diamond-like carbon (DLC) film exhibiting a black color, and the like. Preferably, the thickness of the coating is 0.02 μm or more and 2.0 μm or less because a blue color looks more beautiful. Note that, since the aforementioned titanium member develops a blue color according to the aforementioned principle, it is possible to visually recognize a glittering blue color even though the coating is provided. Furthermore, it is possible to form the coating by a sputtering method, a CVD method, an ion plating method, and the like.

<Decorative Article>

A decorative article according to an embodiment includes the aforementioned titanium member. Examples of the decorative article include a timepiece; ornaments such as glasses and accessories; and a decorative member such as sports goods. More specifically, examples of the decorative article include a part or some of components of the timepiece, for example, exterior parts. The timepiece may be any one of a photovoltaic timepiece, a thermal power generating timepiece, a standard time radio wave reception-type self-correcting timepiece, a mechanical timepiece, and a general electronic timepiece. Such a timepiece is manufactured using the aforementioned titanium member by a publicly known method.

From the above, the present invention relates to the following.

[1] A titanium member having a first region where a plurality of first convex structural bodies extending in a first direction are arranged on the surface of the titanium member in a second direction orthogonal to the first direction, wherein the first convex structural body has first convex portions arranged on the upper surface of the first convex structural body at an interval of several hundred nanometers along the first direction and the height of the first convex portion is several ten nanometers.

[2] A titanium member that has a titanium content of 99 mass % or more and has a first region where a plurality of first convex structural bodies extending in a first direction are arranged on the surface of the titanium member in a second direction orthogonal to the first direction, wherein the first convex structural body has first convex portions arranged on the upper surface of the first convex structural body at an interval of several hundred nanometers along the first direction and the height of the first convex portion is several ten nanometers.

[3] The titanium member according to [1], wherein the titanium member includes a β alloy or an α+β alloy.

[4] The titanium member according to any one of [1] to [3], wherein the first convex structural bodies adjacent in the second direction are arranged at an interval wider than the interval at which the first convex portions are arranged, and in the first convex structural body, a height including the first convex portions is higher than the height of the first convex portions.

[5] The titanium member according to [2], wherein the first region includes a crystal structure preferentially oriented in (102), (110), and (103) planes belonging to an α phase, which is a hexagonal close-packed crystal, or has the crystal structure preferentially oriented in the (102), (110), and (103) planes belonging to the α phase, which is a hexagonal close-packed crystal, and a crystal structure preferentially oriented in a (200) plane belonging to a β phase, which is a body-centered cubic crystal.

[6] The titanium member according to any one of [1] to [5], wherein, in the first region, a difference between an R value and a G value is within 30, and a B value is larger than the R value by 70 or more and is larger than the G value by 70 or more (each of the R value, the G value, and the B value is an integer of 0 or more and 255 or less) in RGB measurement values.

[7] The titanium member according to any one of [1] to [6], wherein the size of the first region is 100 μm or more and 2500 μm or less.

The titanium member of [1] to [7] exhibits a blue color with excellent decorativeness.

[8] The titanium member according to any one of [1] to [7], wherein the titanium member further has a second region where a plurality of second convex structural bodies extending in the first direction are arranged on the surface of the titanium member in the second direction orthogonal to the first direction, the second convex structural body has second convex portions arranged on the upper surface of the second convex structural body at an interval that is narrower than the interval at which the first convex portions are arranged, along the first direction, and the height of the second convex portion is lower than the height of the first convex portion.

The titanium member of [8] exhibits a blue color with excellent decorativeness and a white color with excellent decorativeness.

[9] A method for manufacturing a titanium member that has a first region where a plurality of first convex structural bodies extending in a first direction are arranged on the surface of the titanium member in a second direction orthogonal to the first direction, wherein the first convex structural body has first convex portions arranged on the upper surface of the first convex structural body at an interval of several hundred nanometers along the first direction and the height of the first convex portion is several ten nanometers, the method including: a first heating step of heating a raw material titanium member under reduced pressure by increasing temperature from room temperature to temperature T1 of 730° C. or more to 950° C. or less; a second heating step of heating the raw material titanium member that has been subjected to the first heating step, under reduced pressure by increasing temperature from the temperature T1 to temperature T2 of 900° C. or more to 1150° C. or less that is higher than the temperature T1, over 0.5 hours or more and 8 hours or less; and a cooling step of cooling the raw material titanium member that has been subjected to the second heating step by decreasing temperature from the temperature T2 to temperature lower than the temperature T2 and obtaining the titanium member.

[10] A method for manufacturing a titanium member that has a titanium content of 99 mass % or more and has a first region where a plurality of first convex structural bodies extending in a first direction are arranged on the surface of the titanium member in a second direction orthogonal to the first direction, wherein the first convex structural body has first convex portions arranged on the upper surface of the first convex structural body at an interval of several hundred nanometers along the first direction and the height of the first convex portion is several ten nanometers, the method including: a first heating step of heating a raw material titanium member that has a titanium content of 99 mass % or more, under reduced pressure by increasing temperature from room temperature to temperature T1 of 800° C. or more to 950° C. or less; a second heating step of heating the raw material titanium member that has been subjected to the first heating step, under reduced pressure by increasing temperature from the temperature T1 to temperature T2 of 950° C. or more to 1150° C. or less that is higher than the temperature T1, over 0.5 hours or more and 8 hours or less; and a cooling step of cooling the raw material titanium member that has been subjected to the second heating step by decreasing temperature from the temperature T2 to temperature lower than the temperature T2 and obtaining the titanium member.

[11] The method for manufacturing the titanium member according to [9], wherein the titanium member includes a β alloy or an α+β alloy and the raw material titanium member includes a β alloy or an α+β alloy.

[12] The method for manufacturing the titanium member according to any one of [9] to [11], further including a first holding step of holding the raw material titanium member that has been subjected to the first heating step, under reduced pressure at the temperature T1 for 0.5 hours or more and 3 hours or less, and in the second heating step, the raw material titanium member that has been subjected to the first holding step is heated.

[13] The method for manufacturing the titanium member according to any one of [9] to [12], further including a second holding step of holding the raw material titanium member that has been subjected to the second heating step, under reduced pressure at the temperature T2 for 0.5 hours or more and 6 hours or less, and in the cooling step, the raw material titanium member that has been subjected to the second holding step is cooled to obtain the titanium member.

[14] The method for manufacturing the titanium member according to any one of [9] to [13], wherein, in the second heating step, the raw material titanium member is heated by repeatedly increasing and decreasing temperature.

[15] A method for manufacturing a titanium member that has a titanium content of 99 mass % or more and has a first region where a plurality of first convex structural bodies extending in a first direction are arranged on the surface of the titanium member in a second direction orthogonal to the first direction, wherein the first convex structural body has first convex portions arranged on the upper surface of the first convex structural body at an interval of several hundred nanometers along the first direction and the height of the first convex portion is several ten nanometers, that method including: a first heating step of heating a raw material titanium member that has a titanium content of 99 mass % or more, under reduced pressure by increasing temperature from room temperature to temperature T of 900° C. or more to 1100° C. or less; a first holding step of holding the raw material titanium member that has been subjected to the first heating step, under reduced pressure at the temperature T for 1 hour or more and 8 hours or less; and a cooling step of cooling the raw material titanium member that has been subjected to the first holding step by decreasing temperature from the temperature T to temperature lower than the temperature T and obtaining the titanium member.

According to the method for manufacturing the titanium member according to [9] to [15], the titanium member that exhibits a blue color with excellent decorativeness is obtained.

[16] A decorative article including the titanium member according to any one of [1] to [8].

The decorative article of [16] exhibits a blue color with excellent decorativeness.

Hereinafter, although the present invention will be described in more detail based on examples, the present invention is not limited to these examples.

EXAMPLE

<Analysis Method and Evaluation Method>

[Color Tone, Region Size, and Area Ratio of Regions]

A microscope (manufactured by Keyence Corporation, product name: VHX-5000) was used for evaluating a color tone, a region size (crystal size), and an area ratio of the first region and the second region. The measurement was performed using an epi-illumination system of white ring light at a magnification of 20 times to obtain an image.

Regarding the aforementioned image, a threshold was set to brightness of 100 to 255. By so doing, only the first region and the second region were extracted. Specifically, only (white and blue) crystal regions, other than a black part, were extracted. From this, the total area ratio (%) of the first region and the second region was obtained.

Moreover, saturation of 25 to 255 and hue of 130 to 185 were additionally set to the threshold. By so doing, only the first region (blue crystal region) was extracted. From this, the area ratio (%) of the first region was obtained. Furthermore, the area ratio (%) of the second region was obtained by subtracting the area ratio (%) of the first region from the total area ratio (%) of the first region and the second region.

Furthermore, the extracted first region (blue crystal region) was arbitrarily measured at 10 points or more to obtain respective RGB values, and then an average value of these RGB values was obtained. The obtained average value of the RGB values satisfied the following conditions.

Blue condition: Difference between the R value and the G value is within 30, and the B value is larger than the R value by 70 or more and is larger than the G value by 70 or more. Each of the R value, the G value, and the B value is an integer of 0 or more and 255 or less.

Moreover, the extracted second region (white crystal region) was arbitrarily measured at 10 points or more to obtain respective RGB values, and then an average value of these RGB values was obtained. The obtained average value of the RGB values satisfied the following conditions.

White condition: Each of the R value, the G value, and the B value is 170 or more, the difference between the R value and the G value is within 50, the difference between the G value and the B value is within 50, and the difference between the B value and the R value is within 50. Each of the R value, the G value, and the B value is an integer of 0 or more and 255 or less.

The region size was measured using the microscope image. Specifically, in one first region or one second region, two items of the longitudinal direction (maximum diameter) and the short direction (minimum diameter) were measured and an average value of the two items was obtained. Average values were obtained in the same manner for 10 or more first regions or second regions, and these average values were further averaged to obtain the region size. Note that, for a sample from which the first region was not obtained, the region size was obtained in the same manner as above only for the second region.

The evaluation criteria were set as follows and the samples were evaluated.

0: Neither the blue crystal (first region) nor the white crystal (second region) are obtained.

1: The blue crystal or the white crystal is obtained and the region size is less than 1 mm (1000 μm).

2: The blue crystal or the white crystal is obtained and the region size is 1 mm (1000 μm) or more and less than 1.5 mm (1500 μm).

3: The blue crystal or the white crystal is obtained and the region size is 1.5 mm (1500 μm) or more and the total area ratio of the first region and the second region is less than 10%.

4: The blue crystal or the white crystal is obtained and the region size is 1.5 mm (1500 μm) or more and the total area ratio of the first region and the second region is 10% or more and less than 20%.

5: The blue crystal or the white crystal is obtained and the region size is 1.5 mm (1500 μm) or more and the total area ratio of the first region and the second region is 20% or more.

[Surface Shape Observation and Elemental Analysis]

The surface shape observation was performed using a scanning electron microscope (SEM) (manufactured by Carl Zeiss Microscopy Co., Ltd., product name: Gemini 300). The SEM analysis conditions were an acceleration voltage of 15 kV and a SEM magnification of 10000 times. Furthermore, an energy dispersive X-ray spectroscopy (EDS) (manufactured by BRUKER Co., Ltd.) was used for elemental analysis of a portion specified by the scanning electron microscope. The analysis condition was an acceleration voltage of 3 kV.

[Fine Shape Measurement]

The fine shape measurement was performed using a scanning probe microscope (atomic force microscope, AFM) (manufactured by BRUKER Co., Ltd., product name: Dimension Icon). The measurement position was specified by the microscope image and the SEM image. The measurement was performed under the following conditions.

Mode: In atmosphere, tapping mode (dynamic mode), cantilever: RTESP 300 kHz, spring constant: 40 N/m, scanning frequency: 1 Hz, 0.5 Hz.

For the first region, a swell component was removed from the obtained measured cross-sectional curve of the actual surface (cross-sectional profile obtained by cutting a measurement result of the first region in the first direction) by applying the phase compensation filter of the cutoff value λs. Then, the maximum height (highest peak height+deepest valley depth) and the minimum height (lowest peak height+shallowest valley depth) were measured. From these values, the height range of elements was obtained. Furthermore, the maximum length and the minimum length of one contour element length were measured. From these values, the length range of the elements was obtained. The first direction is a direction along thin lines, which are regularly drawn, which is observed by the microscope mounted on the scanning probe microscope (atomic force microscope (AFM)). Furthermore, also in the cross-sectional profile obtained by cutting the measurement result of the first region in the second direction orthogonal to the first direction, the height range of elements and the length range of the elements were similarly obtained.

Also for the second region, the height range of elements and the length range of the elements were similarly obtained from the obtained measured cross-sectional curve of the actual surface (cross-sectional profile obtained by cutting a measurement result of the second region in the first direction).

[Crystallinity Measurement]

The crystallinity measurement (measurement of crystal orientation due to color tone difference) was performed using an X-ray diffractometer (manufactured by RIGAKU Corp., product name: SmartLab). The measurement was performed under the following conditions.

Overall qualitative analysis conditions X-ray output: 40 kV, 30 mA, scan axis: 2θ/θ, scan range: 5 to 120°, 0.02 step, solar slit: 5 deg, length limiting slit: 15 mm.

Minute part qualitative analysis conditions X-ray output: 40 kV, 30 mA, scan axis: 2θ/θ, scan range: 5 to 120°, 0.02 step, solar slit: 2.5 deg, length limiting slit: 15 mm.

First Example

As a vacuum heat treatment device, a device, which is provided with a diffusion pump capable of evacuating air to a high vacuum of $1.0\times10^{-5}$ Pa or less and can heat samples with a heater therein, was used.

In the manufacturing of sample 1, first, a pure titanium plate material, which is a #800 polished raw material titanium member of JIS class 2, was set in a furnace of the vacuum heat treatment device and air in the furnace was evacuated to 2.0 E-4 Pa. Then, the heating step, the holding step, and the cooling step were performed under the conditions illustrated in FIG. 3 and Table 1 below. Specifically, temperature was increased from room temperature to 880° C. over 1 hour, kept at 880° C. for 3 hours, and was decreased to 150° C. over 3 hours. By so doing, the sample 1 was obtained.

In the manufacturing of samples 2 to 11, as illustrated in Table 1 below, the heating time HT (temperature increasing time), the temperature T (arrival temperature), the holding time KT, and the cooling time (time required for decreasing temperature from the temperature T to 150° C.) were changed.

TABLE 1

| Sample No | Heating time HT (h) | Temperature T (° C.) | Holding time KT (h) | Cooling time (h) | Region size (μm) | Area ratio (%) of first region | Area ratio (%) of second region | Total area ratio (%) of first and second regions | Evaluation result |
|---|---|---|---|---|---|---|---|---|---|
| 1 | 1 | 880 | 3 | 3 | — | 0 | 0 | 0 | 0 |
| 2 | 1 | 900 | 2 | 3 | 102 | 2 | 3 | 5 | 1 |
| 3 | 1 | 900 | 4 | 3 | 134 | 7 | 2 | 9 | 1 |
| 4 | 1 | 900 | 8 | 3 | 180 | 6 | 5 | 11 | 1 |
| 5 | 1 | 950 | 1 | 3 | 892 | 5 | 3 | 8 | 1 |
| 6 | 1 | 950 | 4 | 3 | 1250 | 9 | 5 | 14 | 2 |
| 7 | 1 | 1000 | 3 | 3 | 1324 | 4 | 6 | 10 | 2 |
| 8 | 1 | 1050 | 3 | 3 | 1718 | 4 | 3 | 7 | 3 |
| 9 | 1 | 1050 | 3 | 0.5 (rapid cooling) | 1787 | 5 | 4 | 9 | 3 |
| 10 | 1 | 1100 | 1 | 3 | 1531 | 5 | 6 | 11 | 4 |
| 11 | 1 | 1100 | 3 | 3 | — | 0 | 0 | 0 | 0 |

Figure 4A:
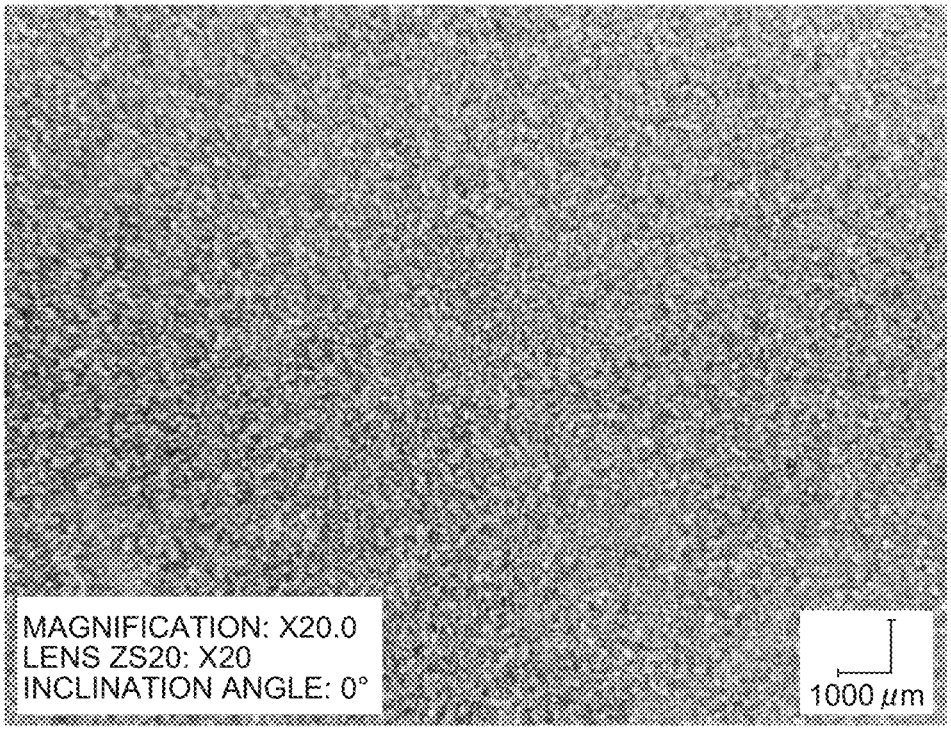
FIG. 4A is a micrograph of sample 3 of a first example.
Figure 4B:
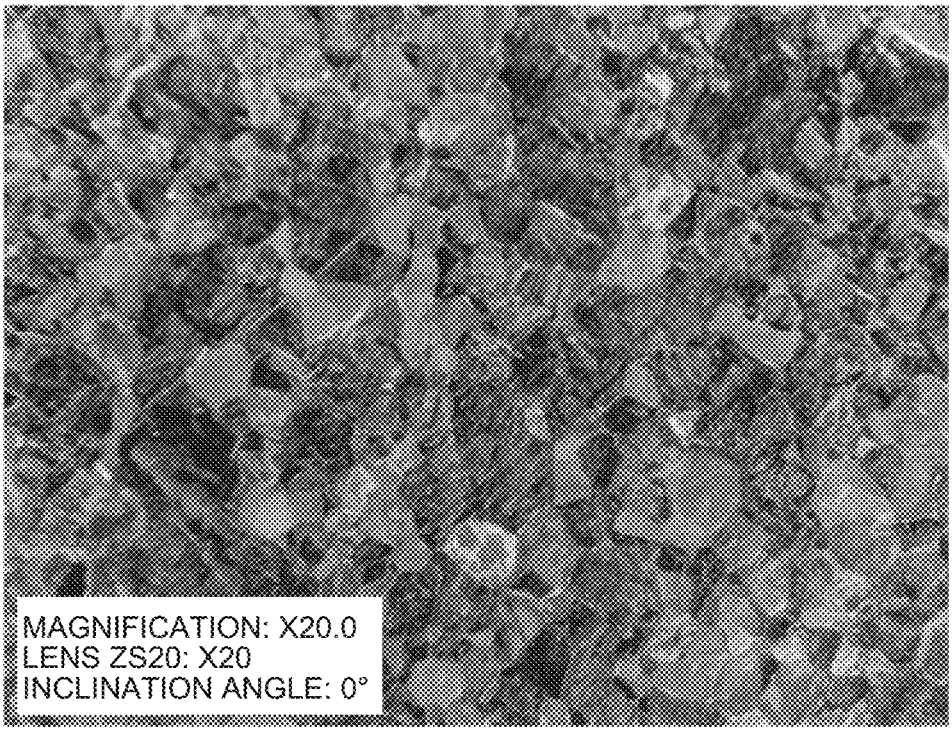
FIG. 4B is a micrograph of sample 6 of the first example.
Figure 4C:
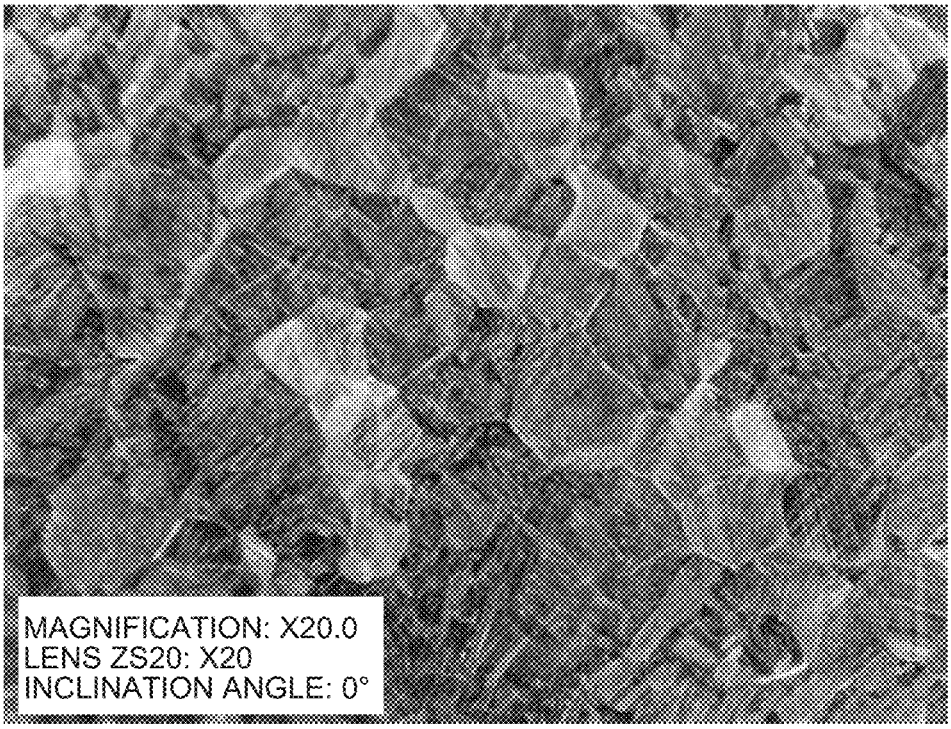
FIG. 4C is a micrograph of sample 8 of the first example.
Figure 4D:
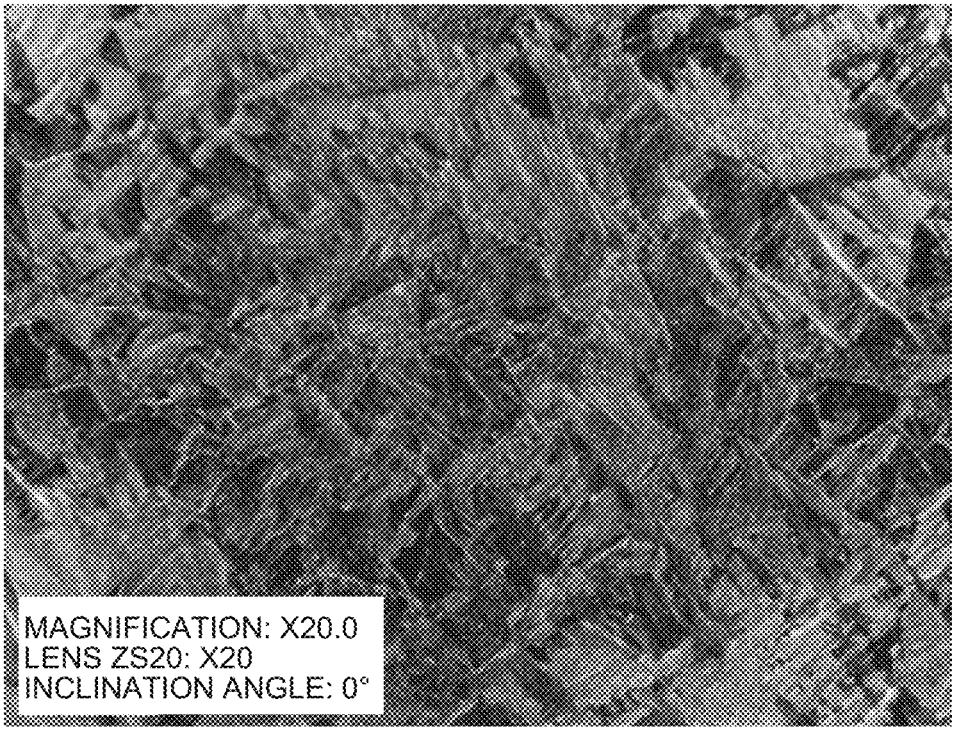
FIG. 4D is a micrograph of sample 10 of the first example.

Representative photographs are illustrated in FIG. 4A to FIG. 4D. That is, FIG. 4A is a micrograph of the sample 3 of the first example. FIG. 4B is a micrograph of the sample 6 of the first example. FIG. 4C is a micrograph of the sample 8 of the first example. FIG. 4D is a micrograph of the sample 10 of the first example.

Table 1 above illustrates the evaluation result of the samples 1 to 11 together. It is understood that from the samples 1 to 10, the crystal size obviously increases as the temperature increases and the holding time becomes longer.

At low temperature of 900° C., crystals that appear blue and white spread evenly over the entire substrate and the size is too small to be visually observed. The crystal size was increased with an increase in the temperature, but when the sample was kept at 1100° C. for 3 hours, since the entire crystal became black (original color of titanium), neither blue crystals nor white crystals were obtained. Furthermore, as the temperature increased, crystals appeared sparsely in the entire substrate.

In the sample 6, the highest crystal amount was obtained among the samples 1 to 10. The crystal size was about 1250 μm, and crystals were obtained relatively evenly on the titanium plate material. The color tone of crystals reflected in blue was R129G145B231 on average, and the color tone of crystals reflected in white was R212G207B207 on average.

Figure 5A:
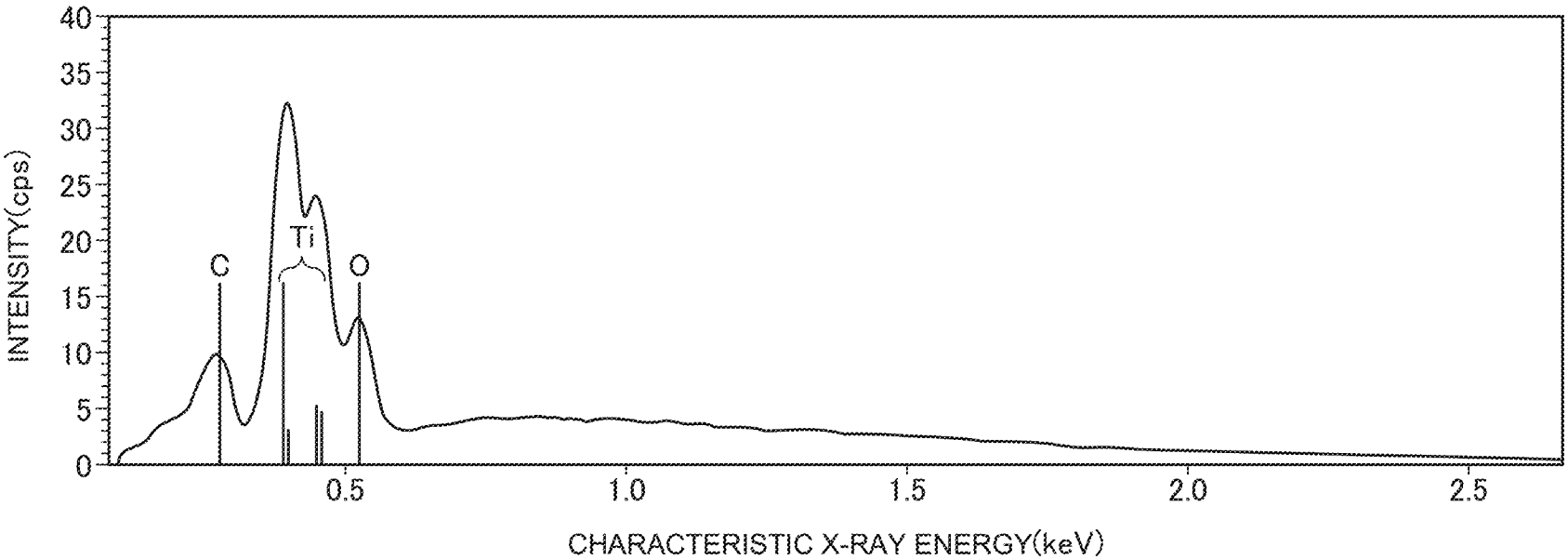
FIG. 5A is an EDS spectrum of a first region of the sample 8 of the first example.
Figure 5B:
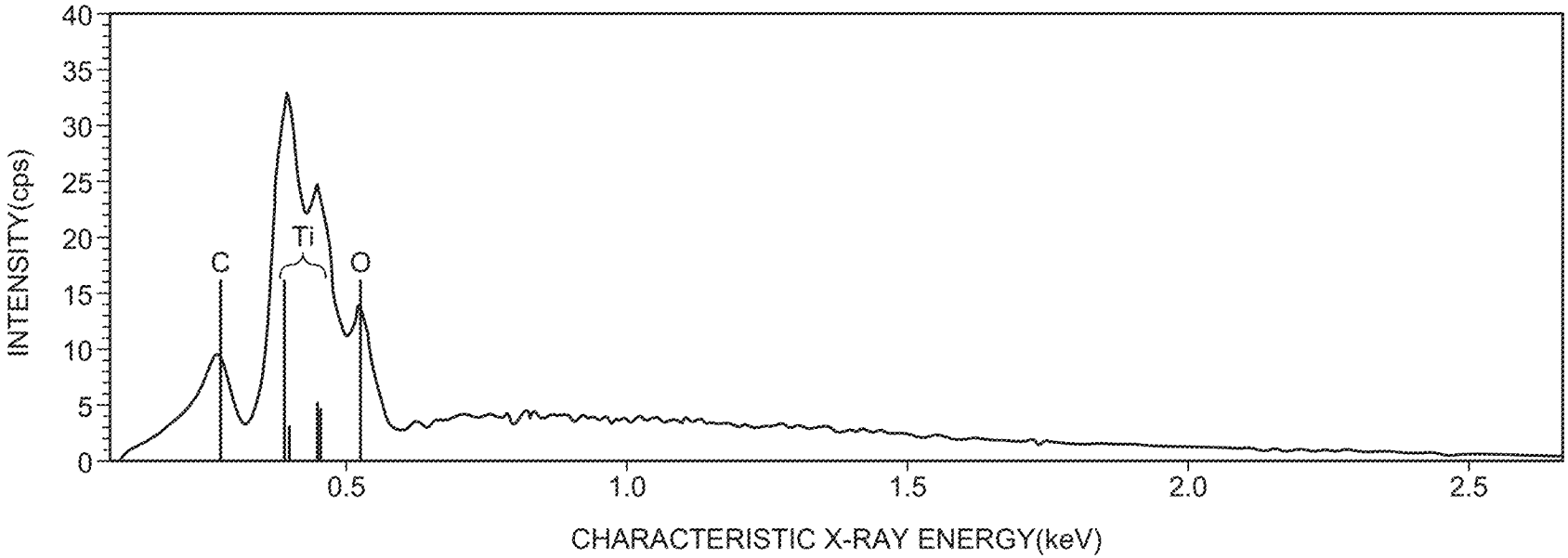
FIG. 5B is an EDS spectrum of a third region of the sample 8 of the first example.

Furthermore, the sample 8 was subjected to the elemental analysis by EDS of crystal parts exhibiting a blue color and a black color. That is, FIG. 5A is an EDS spectrum of a first region of the sample 8 of the first example. FIG. 5B is an EDS spectrum of a third region of the sample 8 of the first example. From FIG. 5A and FIG. 5B, it was found that detected elements were Ti, C, and O, there was no difference in element amounts, and O was present as an oxide of titanium.

Under the simple heat treatment conditions as in the first example, relatively small-sized blue crystals and white crystals were obtained.

Second Example

In the manufacturing of sample 12, first, the pure titanium plate material, which is the #800 polished raw material titanium member of JIS class 2, was set in the furnace of the vacuum heat treatment device and air in the furnace was evacuated to 2.0 E-4 Pa. Then, the first heating step, the second heating step, and the cooling step were performed under the conditions illustrated in FIG. 2 and Table 2 below. Specifically, temperature was increased from room temperature to 850° C. over 1 hour, was increased from 850° C. to 1200° C. over 5 hours, and was decreased from 1200° C. to 150° C. over 3 hours. By so doing, the sample 12 was obtained.

In the manufacturing of samples 13 to 50, as illustrated in Table 2 below, the first holding step and the second holding step were appropriately performed. Specifically, in the manufacturing of the samples 13 to 50, as illustrated in FIG. 2 and Table 2 below, the heating time HT1 (first temperature increasing time), the temperature T1 (temperature increasing start temperature, first arrival temperature), the holding time KT1 (first holding time), the heating time HT2 (second temperature increasing time), the temperature T2 (second arrival temperature), the holding time KT2 (second holding time), and the cooling time (time required for decreasing temperature from the temperature T2 to 150° C.) were changed.

TABLE 2

| Sample No | Heating time HT1 (h) | Temperature T1 (° C.) | Holding time KT1 (h) | Heating time HT2 (h) | Temperature T2 (° C.) | Holding time KT2 (h) | Cooling time (h) | Region size (μm) | Area ratio (%) of first region | Area ratio (%) of second region | Total area ratio (%) of first and second regions | Evaluation result |
|---|---|---|---|---|---|---|---|---|---|---|---|---|
| 12 | 1 | 850 | 0 | 5 | 1200 | 0 | 3 | — | 0 | 0 | 0 | 0 |
| 13 | 1 | 850 | 0 | 3 | 1200 | 0 | 3 | 1771 | 3 | 0 | 3 | 3 |
| 14 | 1 | 950 | 0 | 3 | 1150 | 0 | 3 | 1722 | 2 | 0 | 2 | 3 |
| 15 | 1 | 900 | 0 | 5 | 1150 | 0 | 3 | 1789 | 2 | 0 | 2 | 3 |
| 16 | 1 | 850 | 1 | 3 | 1150 | 0 | 3 | 1822 | 4 | 2 | 6 | 3 |

TABLE 2-continued

| Sample No | Heating time HT1 (h) | Temperature T1 (° C.) | Holding time KT1 (h) | Heating time HT2 (h) | Temperature T2 (° C.) | Holding time KT2 (h) | Cooling time (h) | Region size (μm) | Area ratio (%) of first region | Area ratio (%) of second region | Total area ratio (%) of first and second regions | Evaluation result |
|---|---|---|---|---|---|---|---|---|---|---|---|---|
| 17 | 1 | 850 | 0 | 1 | 1150 | 0 | 3 | 1785 | 8 | 2 | 10 | 4 |
| 18 | 1 | 850 | 0 | 1 | 1150 | 1 | 3 | 1785 | 1 | 3 | 4 | 4 |
| 19 | 1 | 900 | 0 | 3 | 1100 | 0 | 3 | 1738 | 14 | 6 | 20 | 5 |
| 20 | 3 | 900 | 0 | 3 | 1100 | 0 | 3 | 1767 | 12 | 5 | 17 | 4 |
| 21 | 1 | 950 | 0.5 | 0.5 | 1100 | 2 | 3 | 2268 | 2 | 6 | 8 | 3 |
| 22 | 1 | 950 | 0 | 3 | 1100 | 0 | 3 | 1758 | 9 | 1 | 10 | 4 |
| 23 | 1 | 900 | 0 | 5 | 1100 | 0 | 3 | 1699 | 19 | 2 | 21 | 5 |
| 24 | 1 | 900 | 0 | 2 | 1100 | 0 | 3 | 1911 | 25 | 2 | 27 | 5 |
| 25 | 1 | 850 | 0 | 3 | 1100 | 0 | 3 | 1772 | 20 | 3 | 23 | 5 |
| 26 | 1 | 850 | 0 | 3 | 1100 | 0 | 0.5 (rapid cooling) | 1821 | 21 | 2 | 23 | 5 |
| 27 | 1 | 900 | 0 | 3 | 1100 | 0.5 | 3 | 1648 | 16 | 2 | 18 | 4 |
| 28 | 1 | 900 | 0 | 3 | 1100 | 1 | 3 | 2219 | 4 | 2 | 6 | 3 |
| 29 | 1 | 800 | 0 | 5 | 1100 | 0.5 | 3 | 1786 | 12 | 3 | 15 | 4 |
| 30 | 1 | 800 | 0 | 5 | 1100 | 0 | 3 | 1636 | 16 | 1 | 17 | 4 |
| 31 | 1 | 800 | 3 | 5 | 1100 | 0 | 3 | 1600 | 15 | 1 | 17 | 4 |
| 32 | 1 | 850 | 0 | 1 | 1070 | 2 | 3 | 1618 | 3 | 11 | 14 | 4 |
| 33 | 1 | 850 | 0 | 1 | 1070 | 3 | 3 | 1920 | 3 | 1 | 4 | 3 |
| 34 | 1 | 850 | 0 | 3 | 1070 | 0 | 3 | 1740 | 20 | 1 | 21 | 5 |
| 35 | 1 | 850 | 0 | 3 | 1050 | 0 | 10 | 1588 | 18 | 4 | 22 | 5 |
| 36 | 1 | 850 | 0 | 5 | 1050 | 0 | 10 | 1615 | 16 | 5 | 21 | 5 |
| 37 | 1 | 850 | 0 | 8 | 1050 | 0 | 10 | 1520 | 12 | 5 | 17 | 4 |
| 38 | 1 | 850 | 0 | 15 | 1050 | 0 | 3 | 1514 | 10 | 7 | 17 | 4 |
| 39 | 1 | 850 | 0 | 2 | 1050 | 6 | 3 | 1810 | 1 | 9 | 10 | 4 |
| 40 | 1 | 850 | 0 | 2 | 1050 | 3 | 3 | 1768 | 5 | 16 | 21 | 5 |
| 41 | 1 | 850 | 0 | 1 | 1050 | 3 | 3 | 1887 | 8 | 20 | 28 | 5 |
| 42 | 1 | 950 | 0 | 1 | 1050 | 3 | 3 | 1701 | 5 | 8 | 13 | 4 |
| 43 | 1 | 800 | 0 | 1 | 1050 | 3 | 3 | 1789 | 9 | 13 | 22 | 5 |
| 44 | 1 | 850 | 0 | 3 | 1050 | 3 | 3 | 1679 | 7 | 14 | 21 | 5 |
| 45 | 1 | 850 | 0 | 3 | 1050 | 1 | 3 | 1562 | 7 | 18 | 25 | 5 |
| 46 | 1 | 850 | 0 | 1 | 1050 | 2 | 3 | 1503 | 8 | 12 | 20 | 5 |
| 47 | 1 | 850 | 3 | 1 | 1050 | 2 | 3 | 1578 | 9 | 14 | 23 | 5 |
| 48 | 1 | 850 | 0 | 1 | 1050 | 2 | 0.5 (rapid cooling) | 1738 | 6 | 15 | 21 | 5 |
| 49 | 1.5 | 850 | 0 | 2 | 1050 | 2 | 3 | 1501 | 3 | 18 | 21 | 5 |
| 50 | 1 | 820 | 0 | 8 | 1020 | 0 | 3 | 1271 | 23 | 5 | 28 | 2 |

Figure 6A:
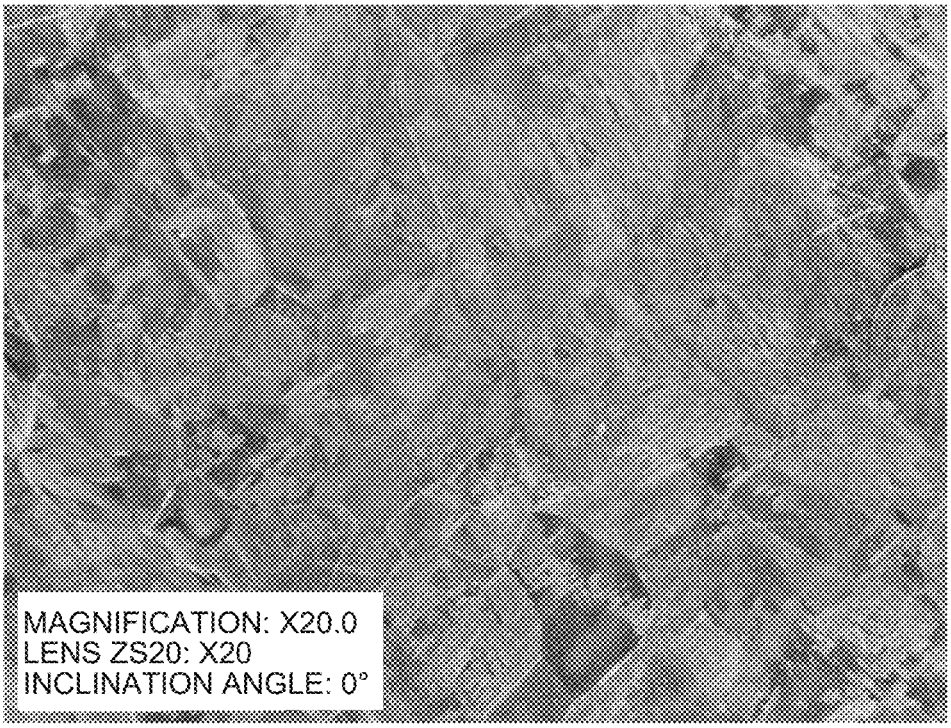
FIG. 6A is a micrograph of sample 12 of a second example.
Figure 6B:
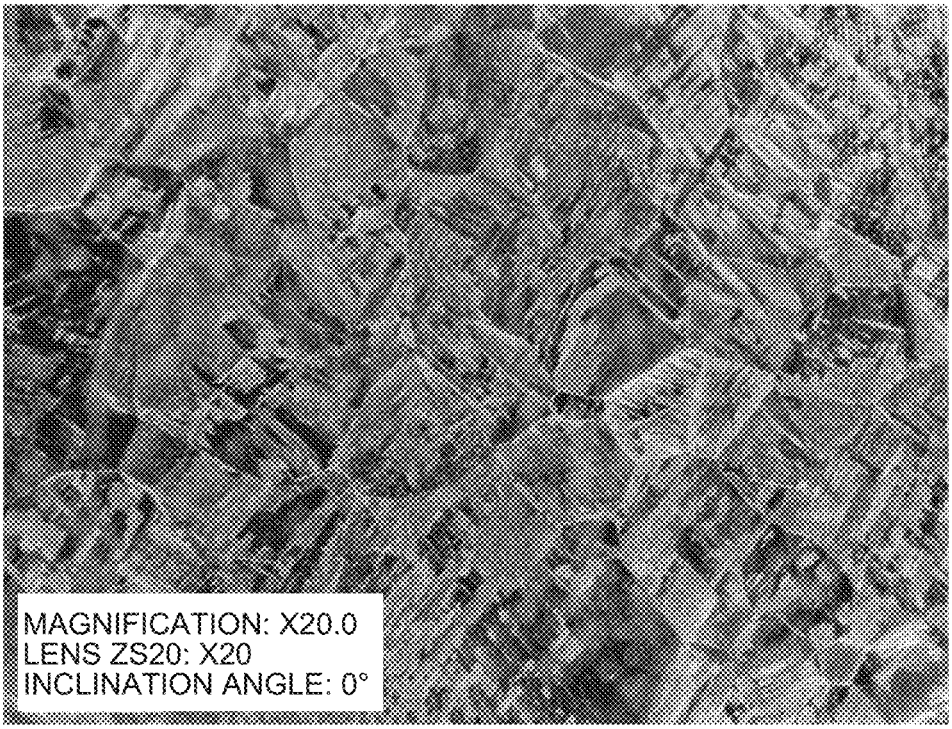
FIG. 6B is a micrograph of sample 15 of the second example.
Figure 6C:
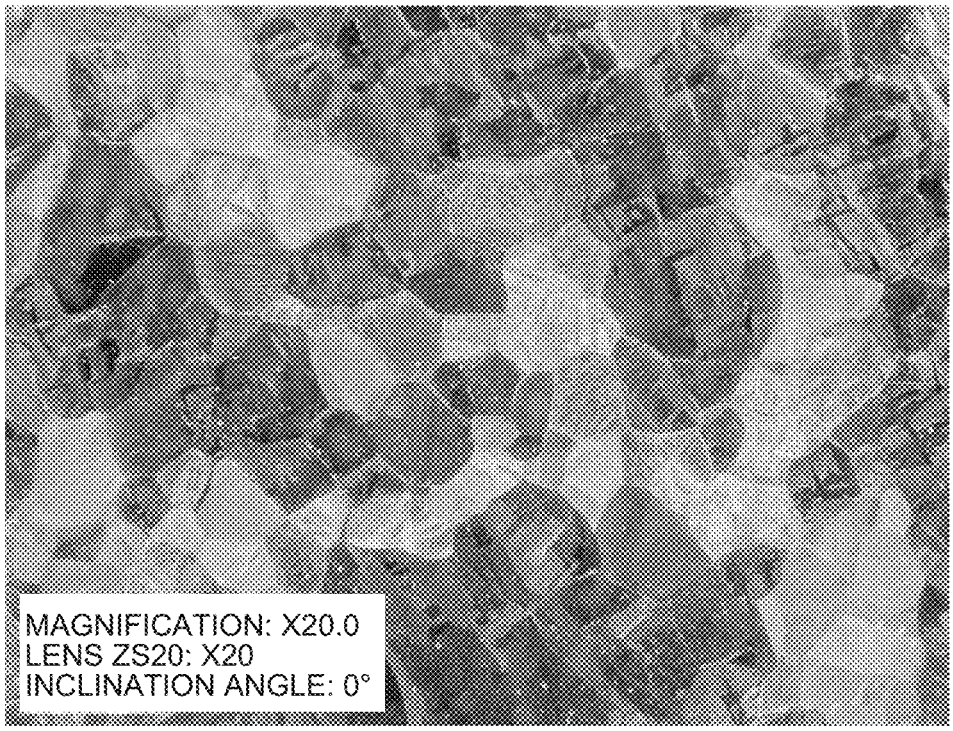
FIG. 6C is a micrograph of sample 23 of the second example.
Figure 6D:
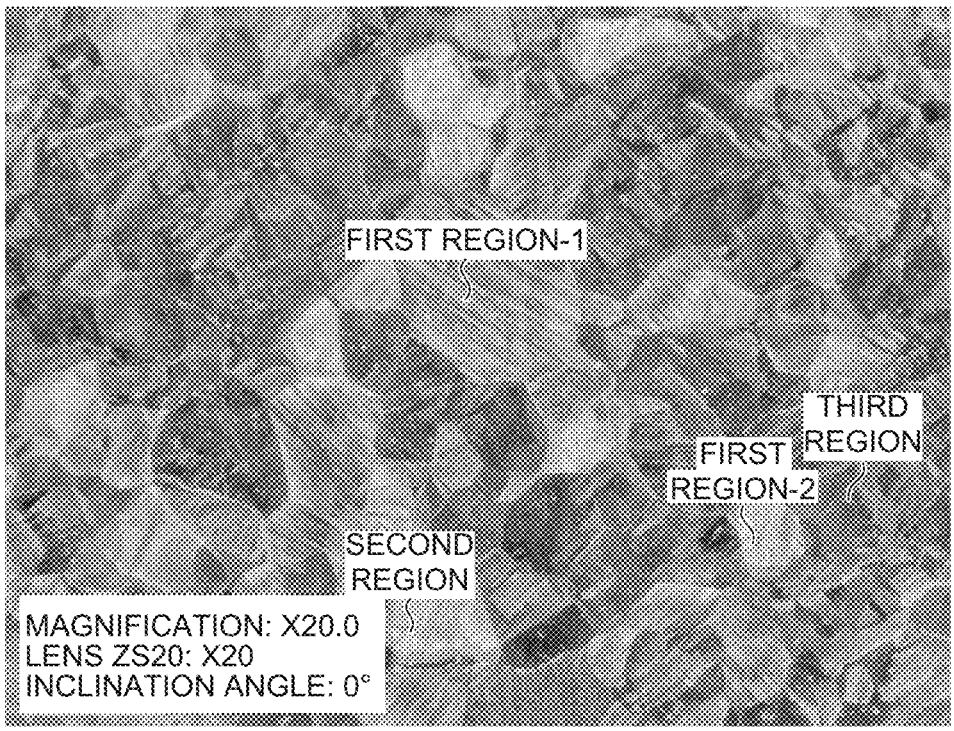
FIG. 6D is a micrograph of sample 24 of the second example.
Figure 6E:
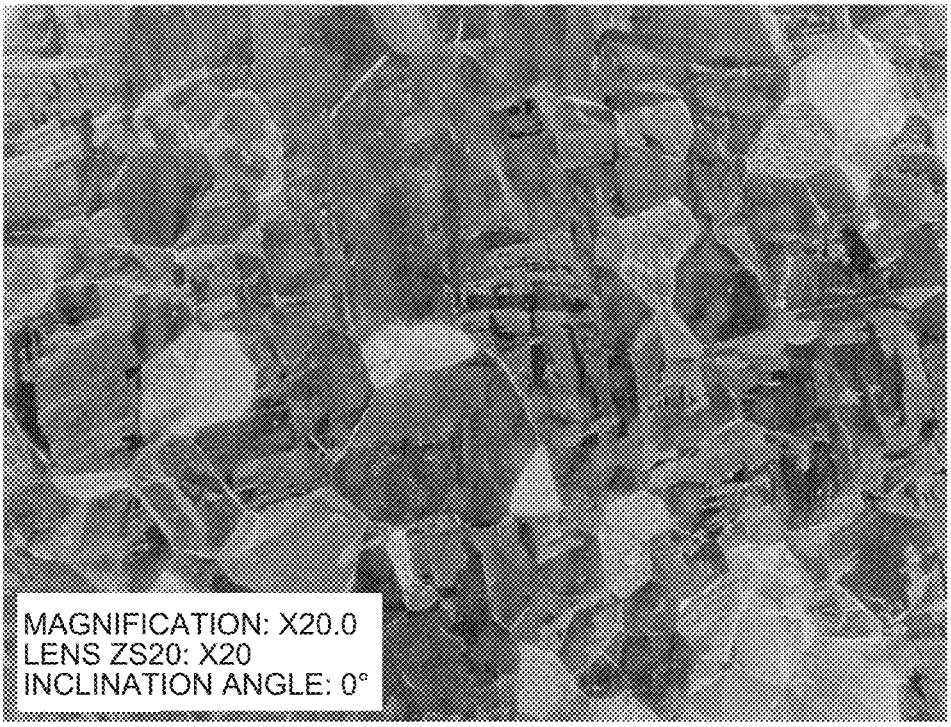
FIG. 6E is a micrograph of sample 28 of the second example.
Figure 6F:
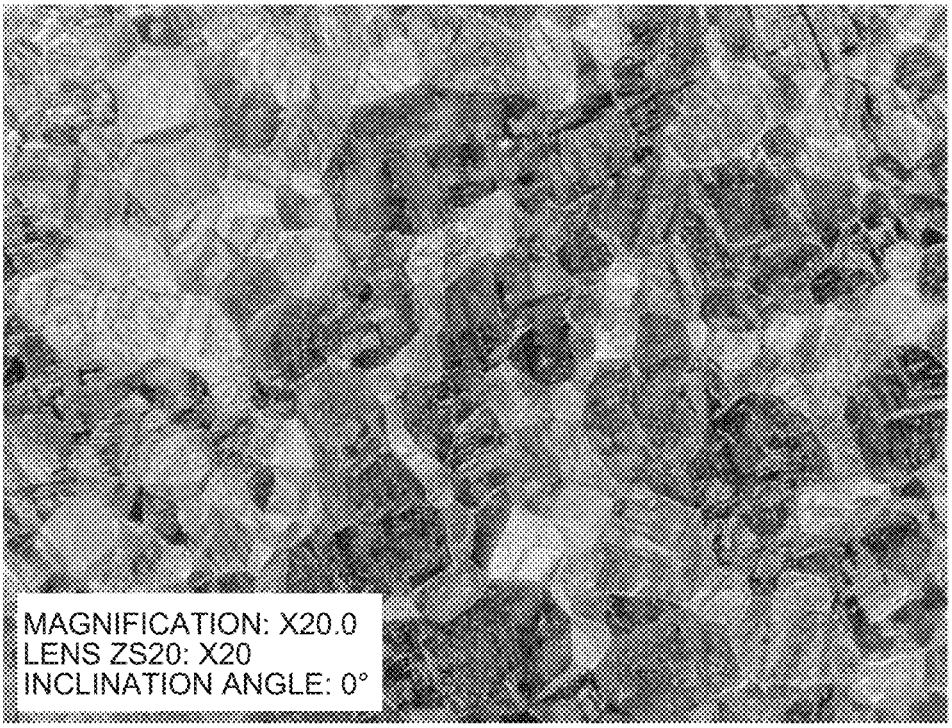
FIG. 6F is a micrograph of sample 34 of the second example.
Figure 6G:
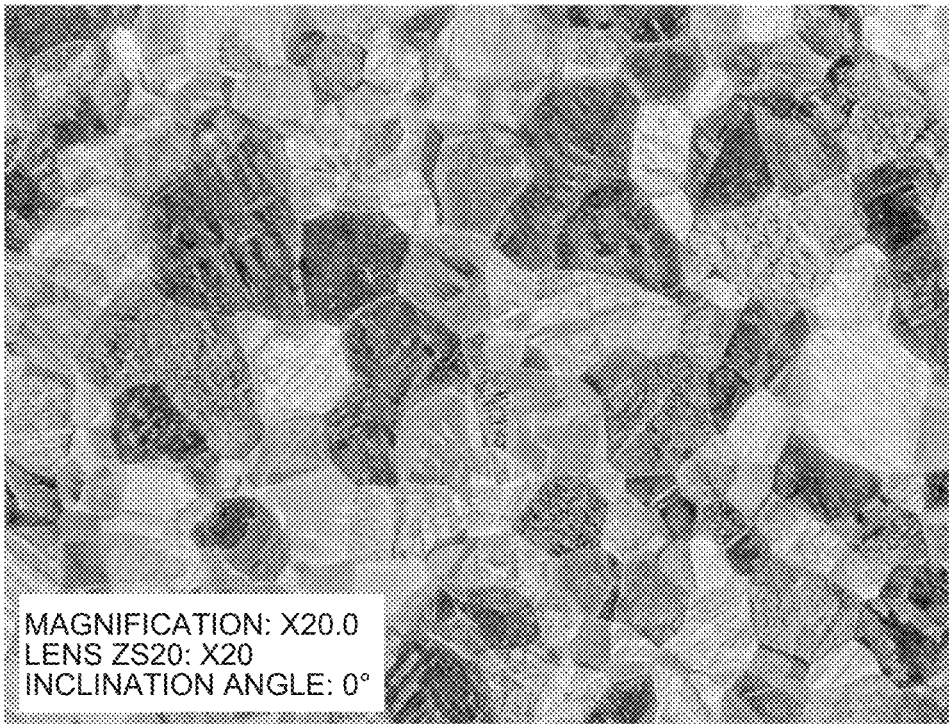
FIG. 6G is a micrograph of sample 41 of the second example.
Figure 6H:
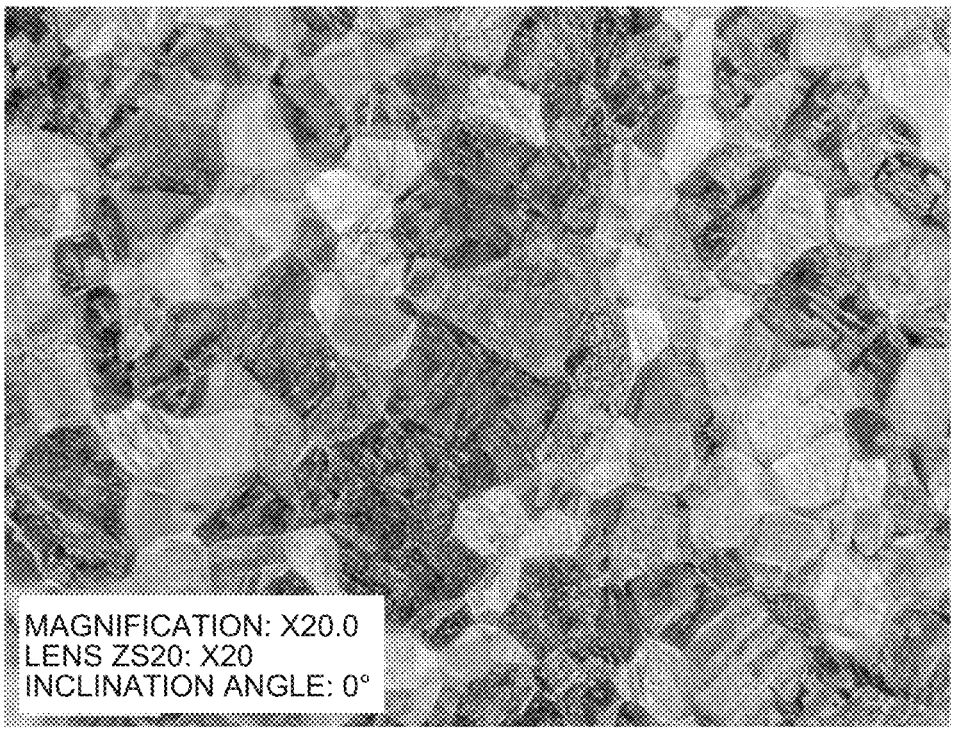
FIG. 6H is a micrograph of sample 45 of the second example.
Figure 6I:
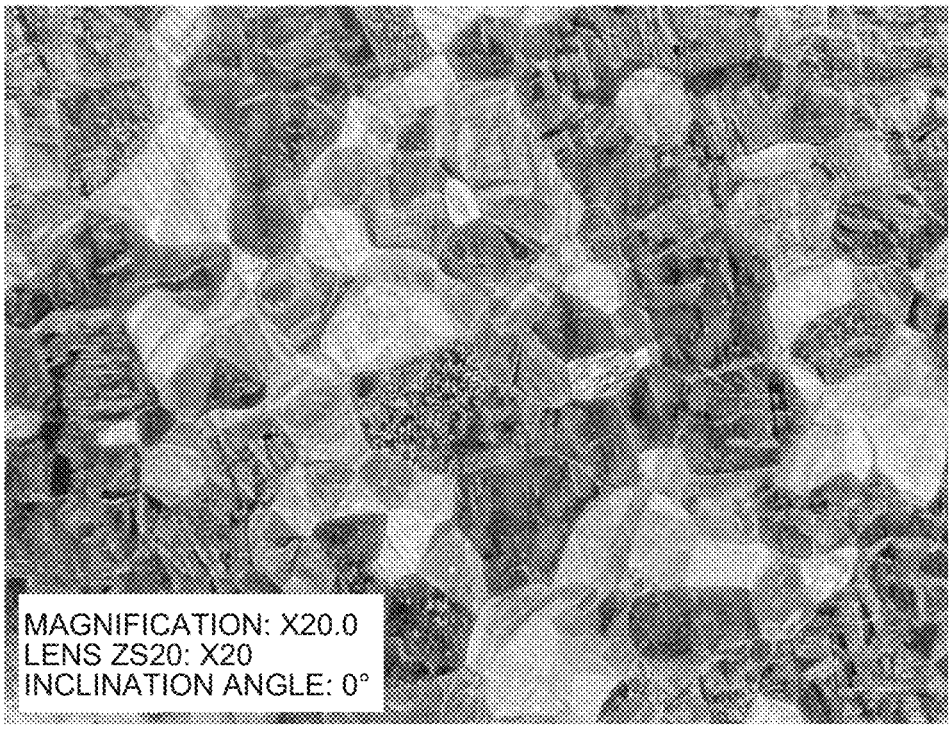
FIG. 6I is a micrograph of sample 49 of the second example.
Figure 6J:
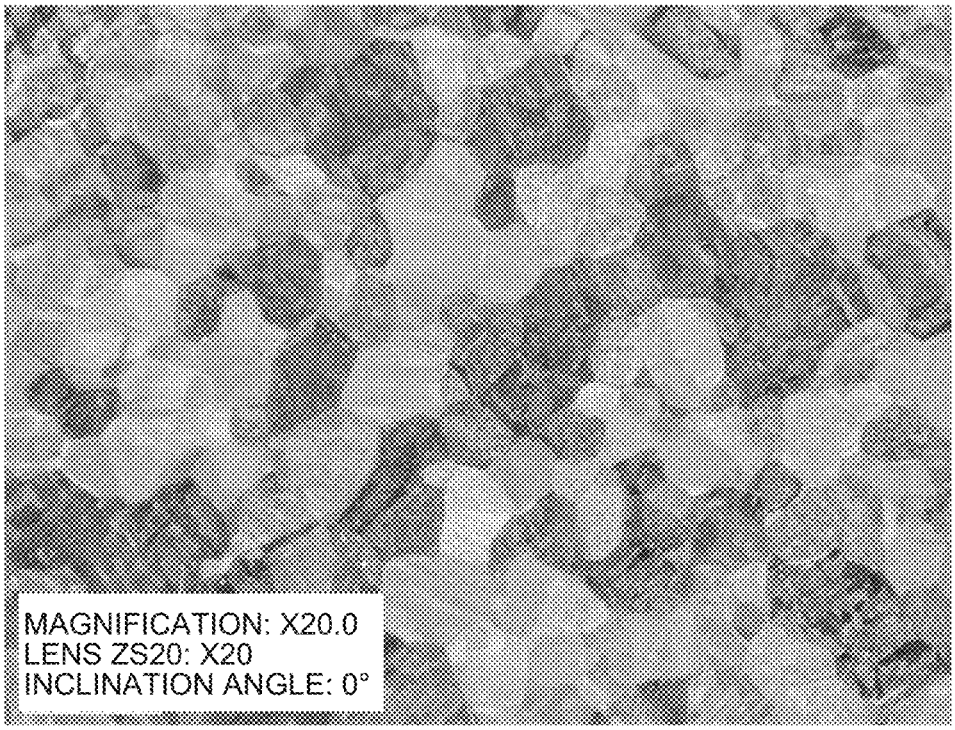
FIG. 6J is a micrograph of sample 50 of the second example.

Representative photographs are illustrated in FIG. 6A to FIG. 6J. That is, FIG. 6A is a micrograph of the sample 12 of the second example. FIG. 6B is a micrograph of the sample 15 of the second example. FIG. 6C is a micrograph of the sample 23 of the second example. FIG. 6D is a micrograph of the sample 24 of the second example. FIG. 6E is a micrograph of the sample 28 of the second example. FIG. 6F is a micrograph of the sample 34 of the second example. FIG. 6G is a micrograph of the sample 41 of the second example. FIG. 6H is a micrograph of the sample 45 of the second example. FIG. 6I is a micrograph of the sample 49 of the second example. FIG. 6J is a micrograph of the sample 50 of the second example.

Table 2 above illustrates the evaluation result of the samples 12 to 50 together. As in the samples 12 and 13, when heating was performed up to the second arrival temperature 1200° C., the entire crystal became large through changing from blue crystals to white crystals, resulting in black (original color of titanium). It was considered that when the temperature was increased to 1200° C. for 3 hours, needle-like crystals generated at the time of transition from an α phase to a β phase remained slightly and blue crystals remained.

As in the samples 14 to 18, when heating was performed up to the second arrival temperature 1150° C., black was dominant similarly to the case of the second arrival temperature 1200° C. However, as in the sample 17, when the second temperature increasing time was as short as 1 hour, blue crystals were increased to 8% and the total crystal amount reached 10%. The sample 18 was performed under the same conditions as the sample 17 except that the second holding time was changed from 0 hours to 1 hour, but the crystal amount was significantly decreased and black was dominant. From this result, it was understood that the balance among the second temperature increasing time, the second arrival temperature, and the second holding time is an important factor because blue crystals grow depending on the second temperature increasing time and there is a change from the blue crystals to white crystals and black depending on the second holding time at the second arrival temperature.

In the case of the samples 19 to 31, the second arrival temperature was set to 1100° C. When the second arrival temperature was set to 1100° C., the total crystal amount was obviously increased compared to the cases of 1200° C. and 1150° C. In the samples 19, 20, and 25, there was a difference in the first temperature increasing time and the first arrival temperature. The sample 20 has a smaller total crystal amount than the sample 19. It is considered that this is because the first arrival temperature was 900° C. and the phase transition temperature 885° C. of titanium was exceeded. Furthermore, it is considered that in the sample 20, the crystal amount was decreased due to a long residence time at temperature exceeding 885° C. It is considered that in the sample 25, blue crystals ware stably increased when temperature increased from 850° C. to 1100° C. because the first arrival temperature was 850° C. and lower than the phase transition temperature 885° C.

In the samples 20, 27, and 28, there is a difference in the second holding time. Under the temperature condition of 1100° C., the crystal amount was decreased as the second holding time becomes longer.

In the samples 19, 23, and 24, there was a difference in the second temperature increasing time. When the second arrival temperature is 1100° C., the crystal amount is largest at 27% when the second temperature increasing time is 2 hours. The crystal amount tends to decrease as the second temperature increasing time becomes longer.

In the samples 30 and 31, the first arrival temperature was 800° C. and the first holding times were 0 hours and 3 hours. Since the temperature condition was lower than the phase transition temperature 885° C., there was no change in the crystal amount. The first arrival temperature is preferably equal to or less than the phase transition temperature 885° C.

In the samples 25 and 26, there was a difference due to the presence or absence of rapid cooling. There was no significant change in the crystal amount.

When the second arrival temperature is 1150° C., it is possible to increase the blue crystals by setting the second temperature increasing time to about 2 hours. On the other hand, the amount of white crystals that appear due to change from the blue crystals does not increase so much.

In the case of the samples 35 to 48, the second arrival temperature was set to 1050° C. At 1050° C., the crystal amount was increased as a whole. About 1050° C. is considered to be optimal in order to stably ensure the crystal amount.

In the samples 35 to 38, the second temperature increasing time was changed up to 3 hours to 15 hours. It was observed that, when the second temperature increasing time becomes longer, the amount of blue crystals tends to decrease and white crystals tend to slightly increase. Since there is no significant difference in 8 hours and 15 hours, 8 hours or less is considered appropriate.

In the case of the samples 35, 44, and 45, the second temperature increasing time was set to 3 hours and the second holding time was changed. When the second holding time became longer, white crystals were increased due to a transition from blue crystals to the white crystals.

In the samples 46 and 47, the first arrival temperature was 850° C. and the first holding times were 0 hours and 3 hours. Since the first arrival temperature was equal to or less than the phase transition temperature 885° C. of titanium, there was no significant change in the crystal amount.

In the samples 46 and 48, the cooling times are 3 hours and 0.5 hours (rapid cooling). There was no significant change in the crystal amount.

In the case of the sample 50, the second arrival temperature was set to 1020° C. By setting the second temperature increasing time to 8 hours, blue crystals became 23%. However, since the second arrival temperature was as low as 1020° C., the crystal size was relatively small at 1271 μm.

Figure 7A:
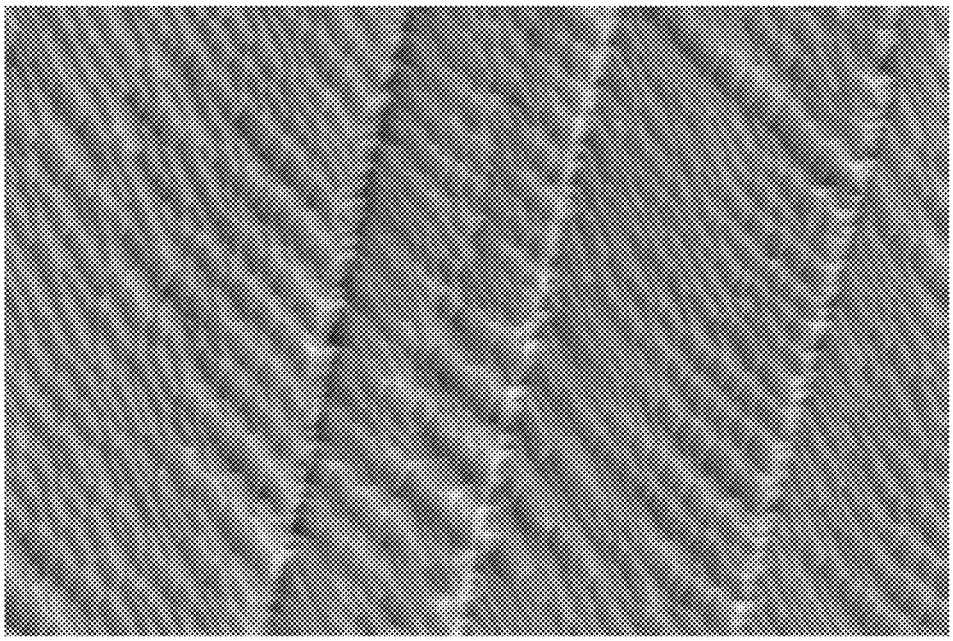
FIG. 7A is a scanning electron microscope image of a first region −1 of the sample 24 of the second example.
Figure 7B:
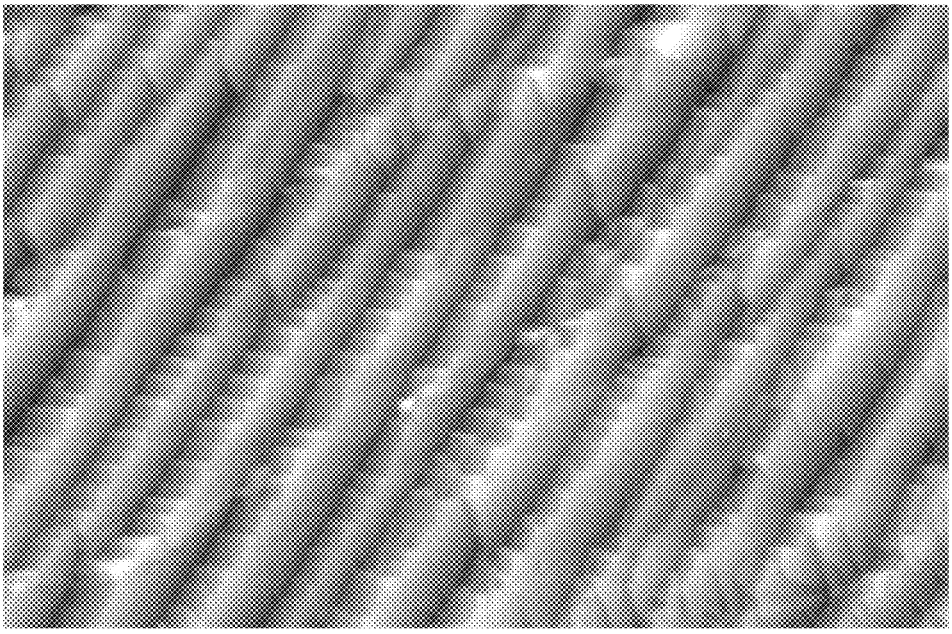
FIG. 7B is a scanning electron microscope image of a second region of the sample 24 of the second example.
Figure 7C:
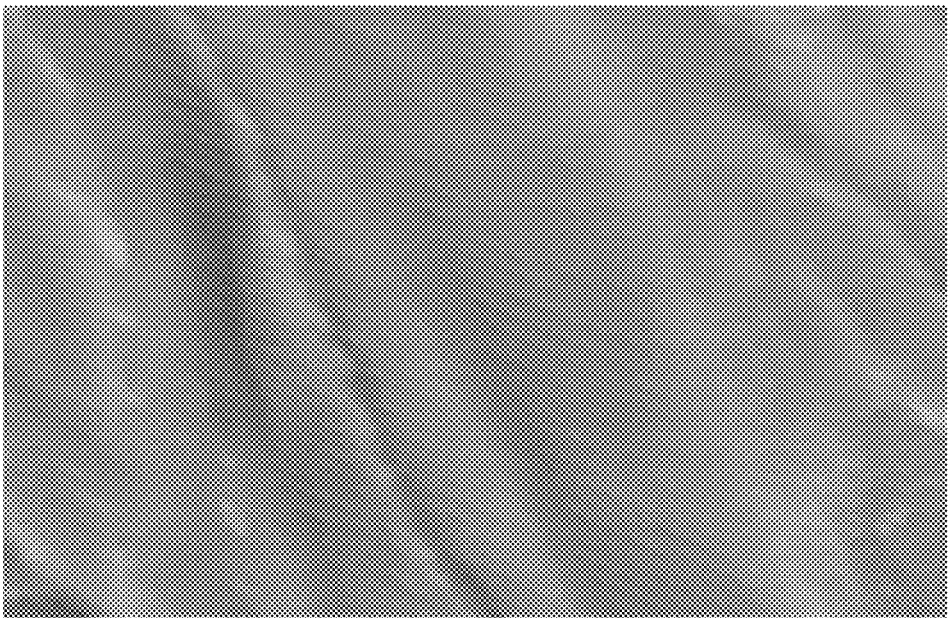
FIG. 7C is a scanning electron microscope image of a third region of the sample 24 of the second example.

Representative scanning electron microscope images are illustrated in FIG. 7A to FIG. 7C. That is, FIG. 7A is a scanning electron microscope image of a first region −1 of the sample 24 of the second example. FIG. 7B is a scanning electron microscope image of a second region of the sample 24 of the second example. FIG. 7C is a scanning electron microscope image of a third region of the sample 24 of the second example. FIG. 7A to FIG. 7C correspond to the scanning electron microscope images of the first region −1, the second region, and the third region in FIG. 6D, respectively. The blue crystal part (first region −1) was confirmed to have a fine structure in which very fine scale-like shelves were regularly arranged in a stepwise manner. The white crystal part (second region) was confirmed to have a structure in which the shape of the shelf became larger than the blue crystal part and the shelves were similarly arranged in a stepwise manner. In the black part (third region), remnants of the shelves were visible, but no clear crystal structure was confirmed, and the surface was almost flat.

Figure 8A:
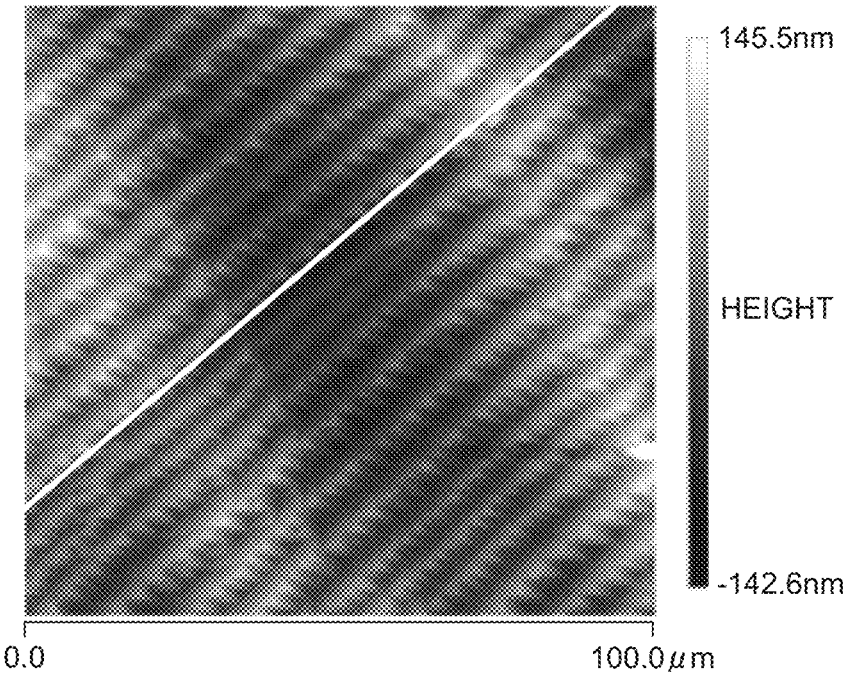
FIG. 8A is an AFM photograph of the first region −1 of the sample 24 of the second example.
Figure 8B:
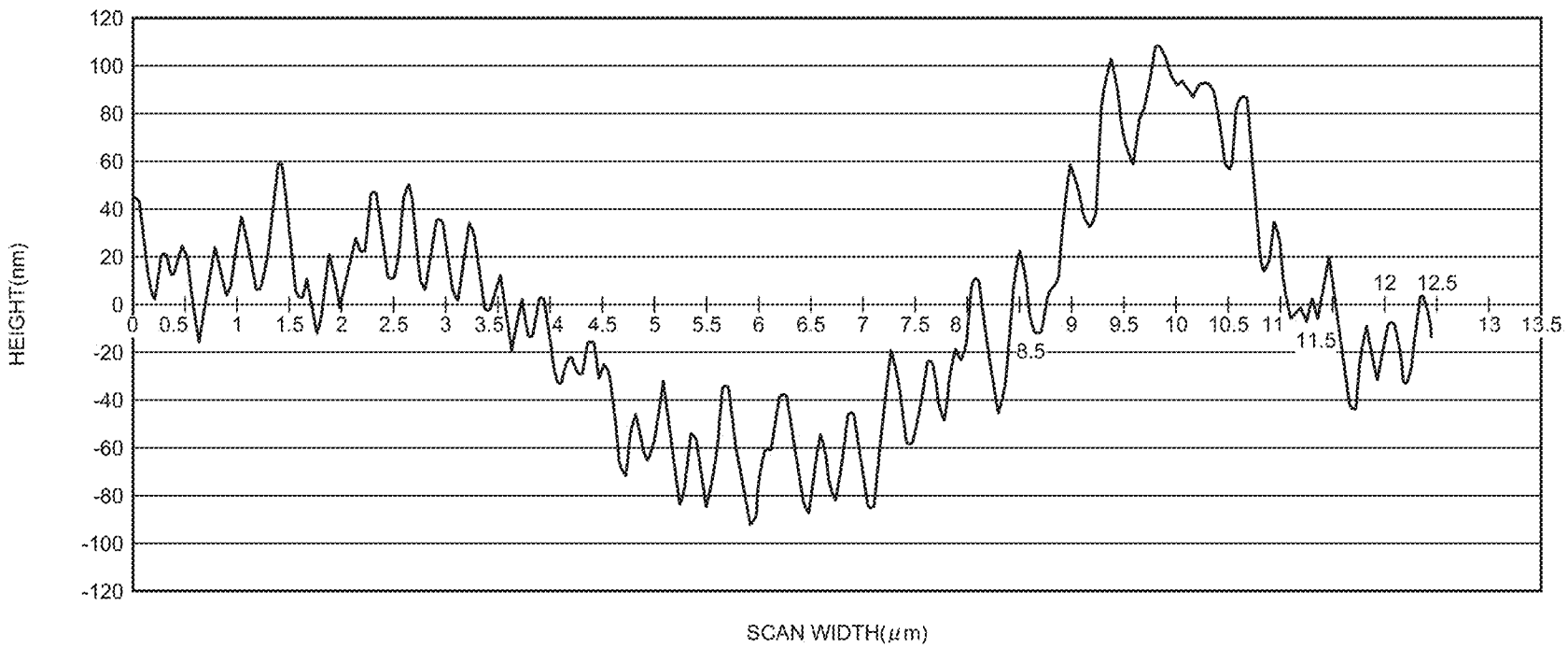
FIG. 8B is an AFM cross-sectional profile of the first region −1 of the sample 24 of the second example.
Figure 9A:
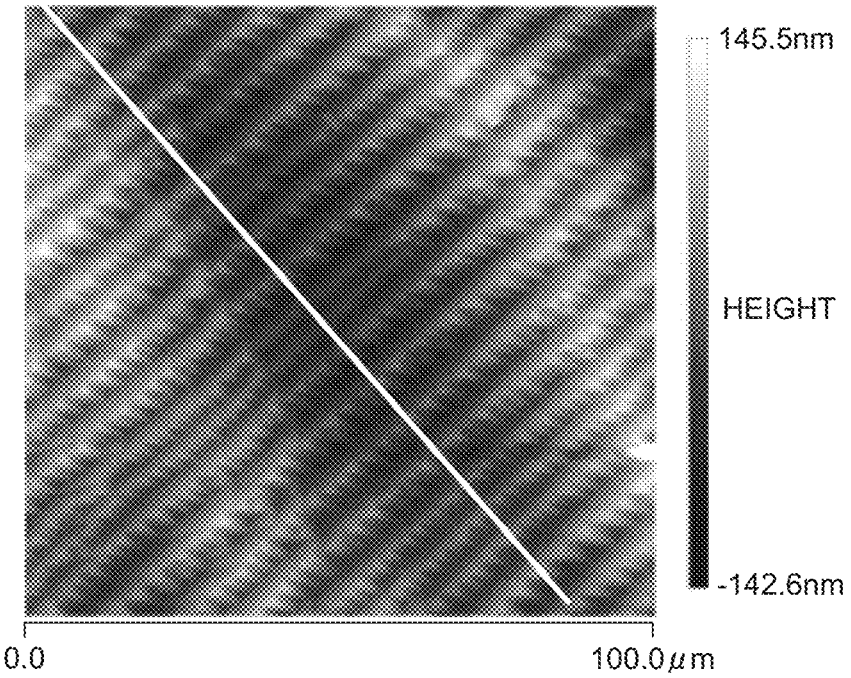
FIG. 9A is an AFM photograph of the first region −1 of the sample 24 of the second example.
Figure 9B:
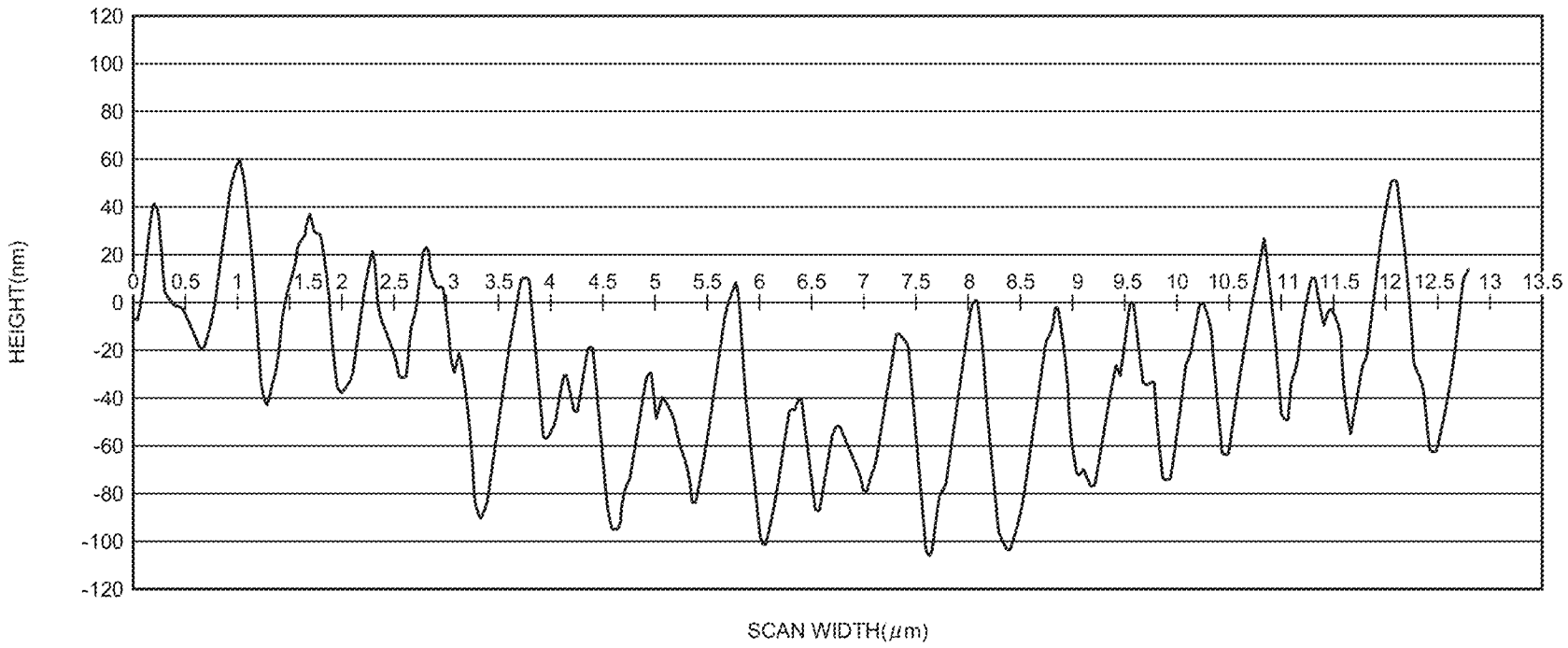
FIG. 9B is an AFM cross-sectional profile of the first region −1 of the sample 24 of the second example.
Figure 10A:
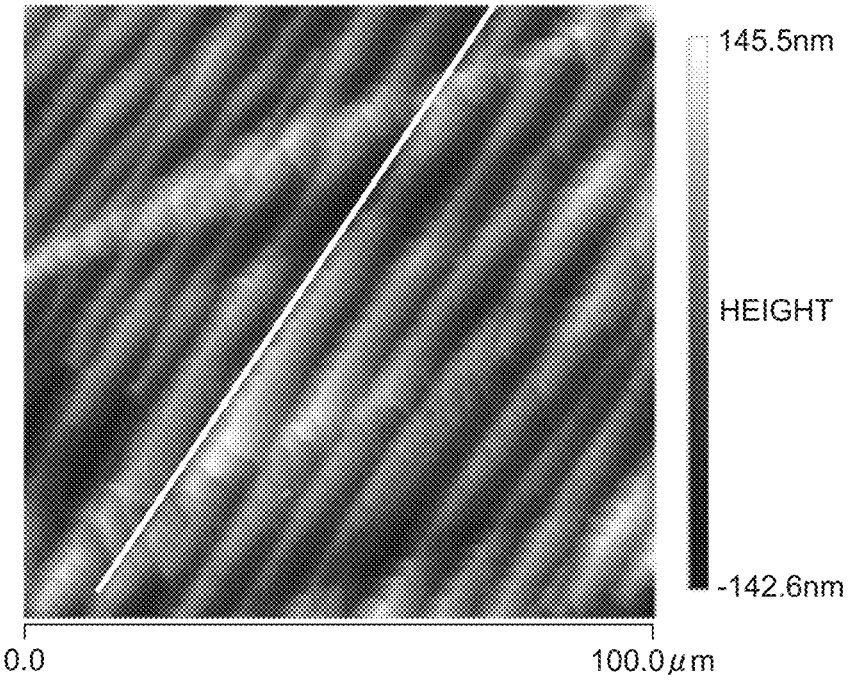
FIG. 10A is an AFM photograph of the second region of the sample 24 of the second example.
Figure 10B:
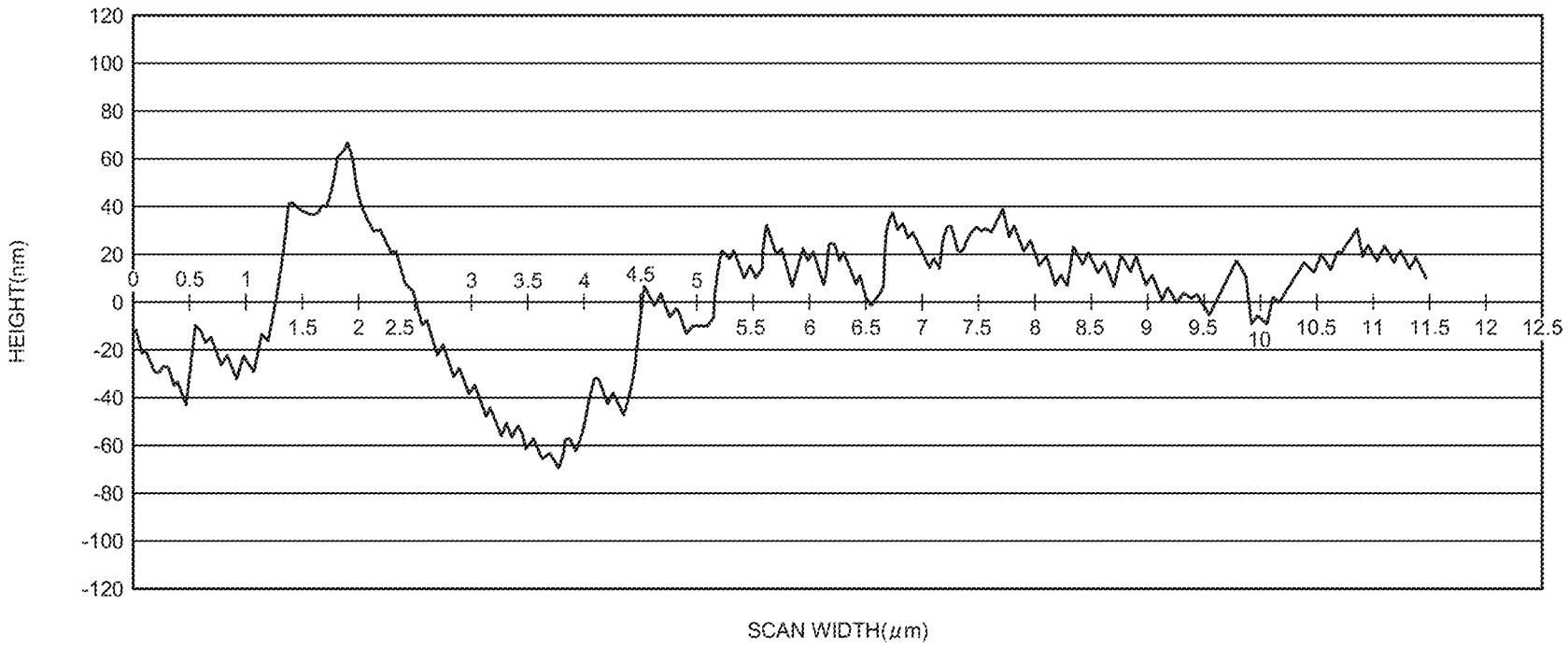
FIG. 10B is an AFM cross-sectional profile of the second region of the sample 24 of the second example.
Figure 11A:
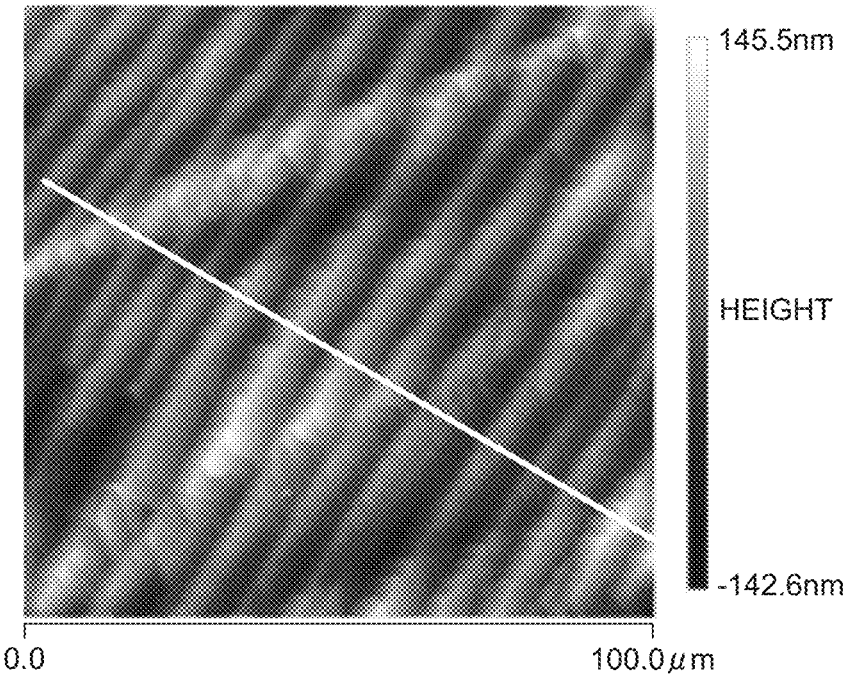
FIG. 11A is an AFM photograph of the second region of the sample 24 of the second example.
Figure 11B:
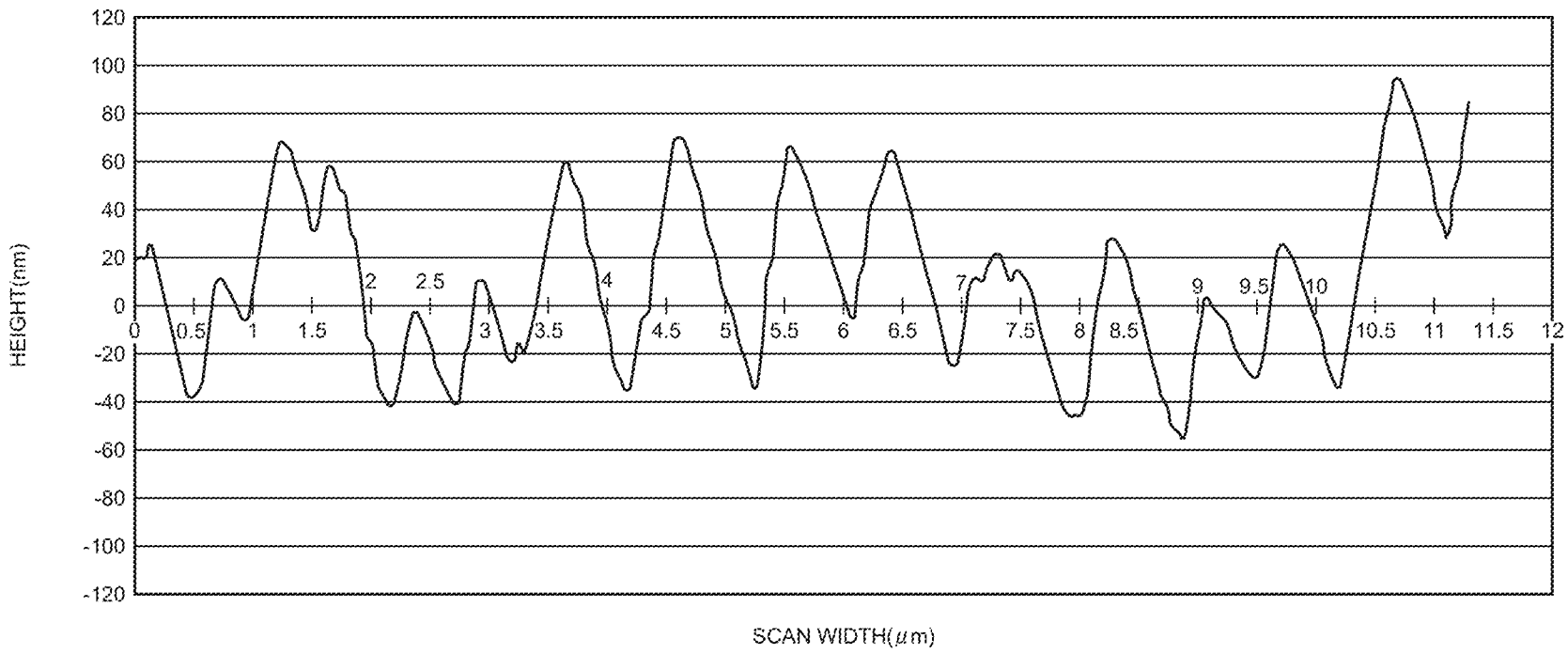
FIG. 11B is an AFM cross-sectional profile of the second region of the sample 24 of the second example.
Figure 12A:
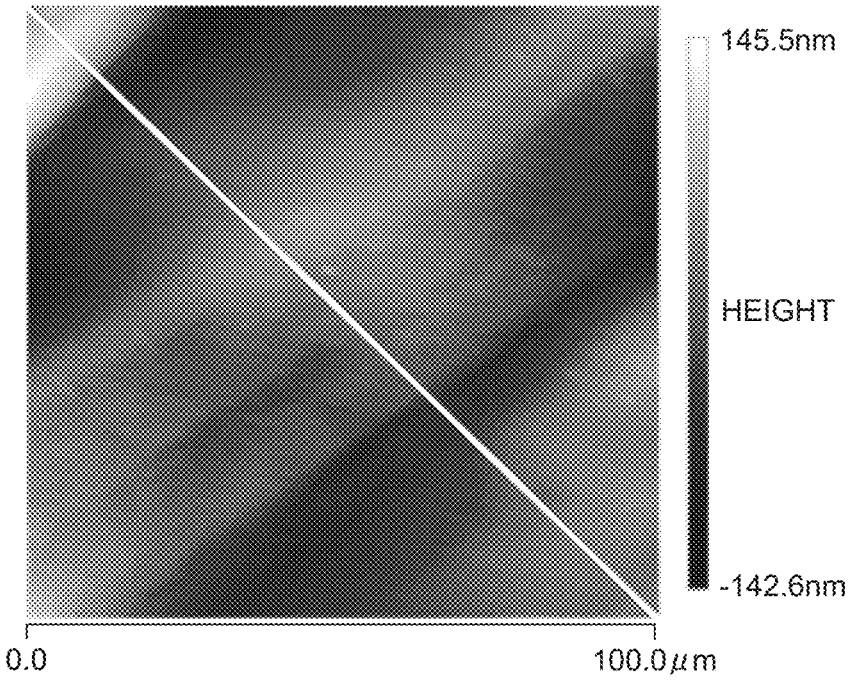
FIG. 12A is an AFM photograph of the third region of the sample 24 of the second example.
Figure 12B:
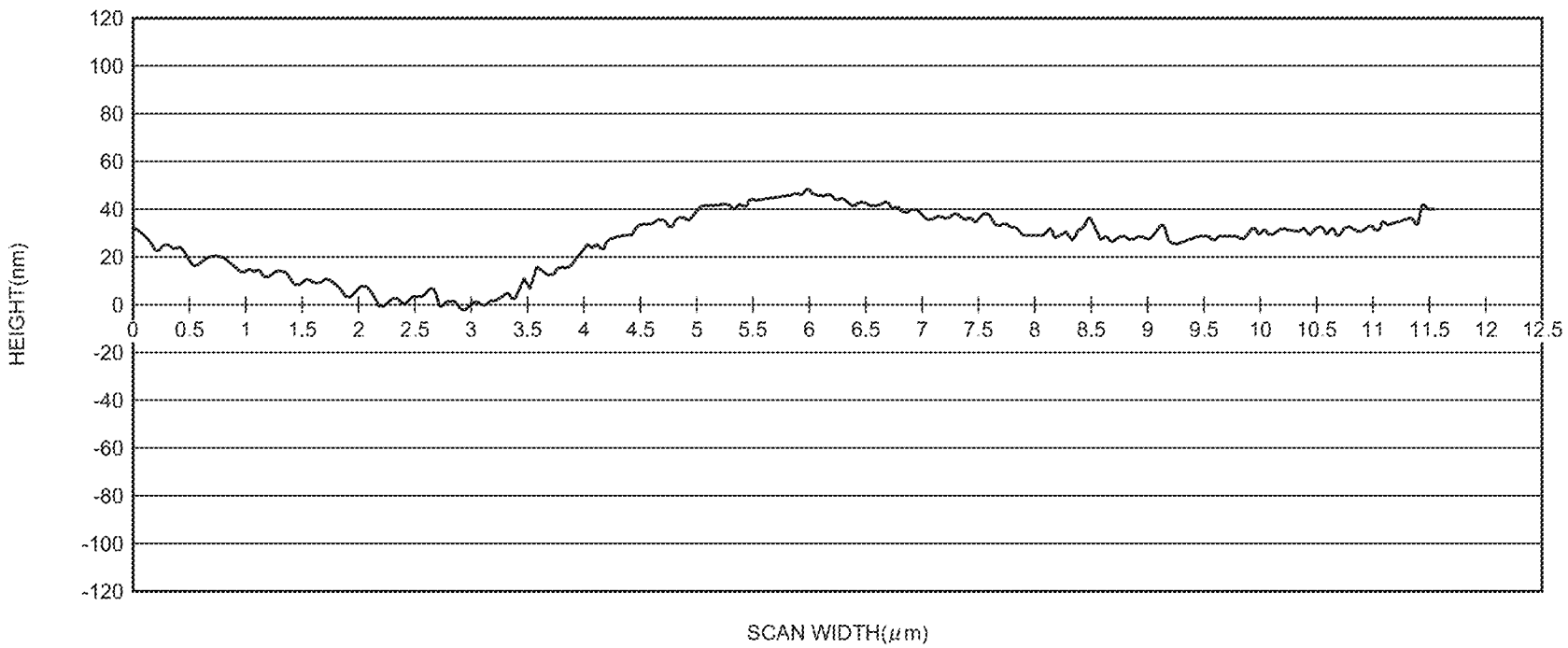
FIG. 12B is an AFM cross-sectional profile of the third region of the sample 24 of the second example.
Figure 13A:
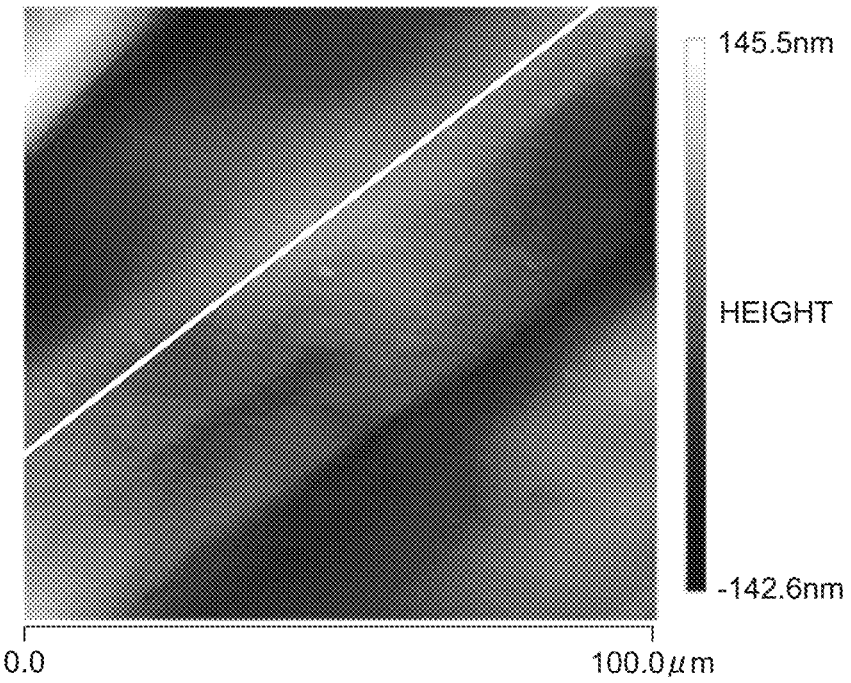
FIG. 13A is an AFM photograph of the third region of the sample 24 of the second example.
Figure 13B:
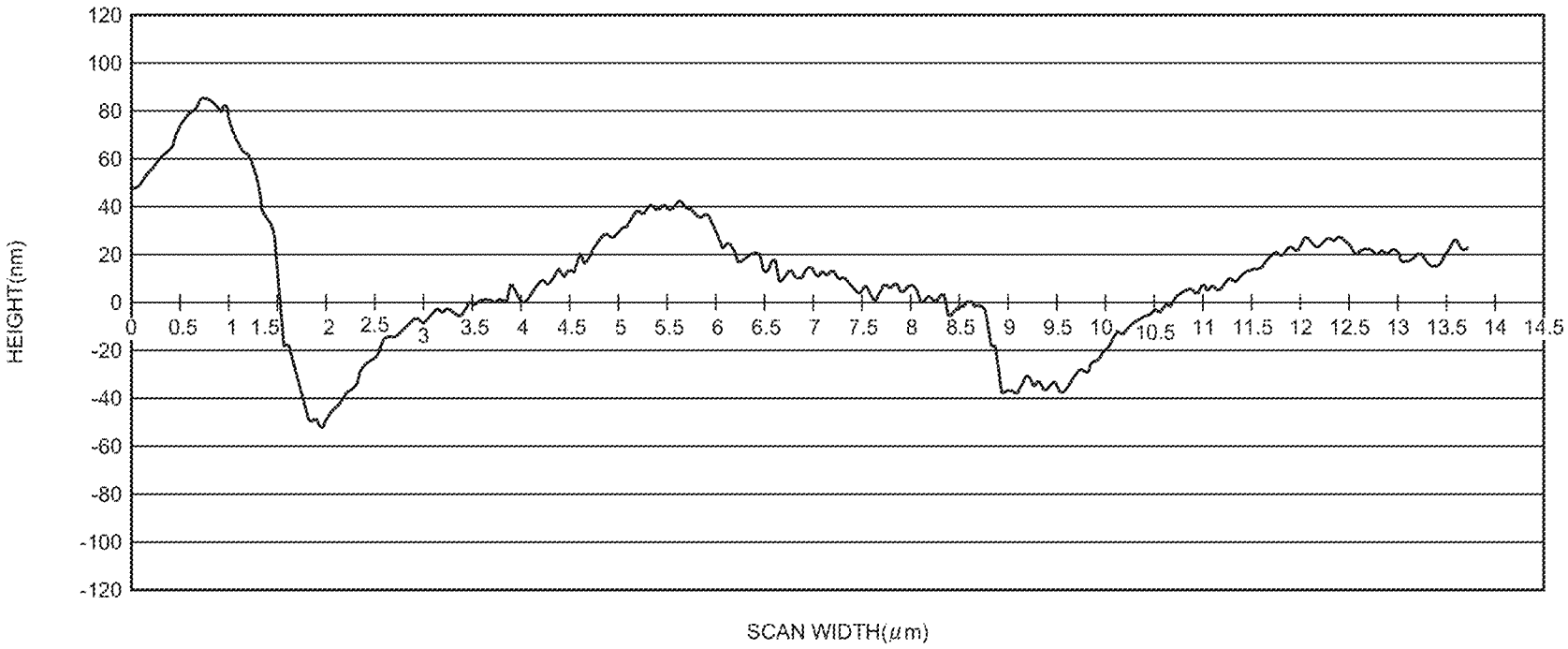
FIG. 13B is an AFM cross-sectional profile of the third region of the sample 24 of the second example.

In order to examine the shelf structure in more detail, fine shape analysis was performed using a scanning probe microscope. The scanning electron microscope image and the scanning probe microscope image were not obtained by measuring completely the same position, but obtained by measuring approximately the same position. That is, FIG. 8A and FIG. 9A are AFM photographs of the first region −1 of the sample 24 of the second example. FIG. 8B and FIG. 9B are AFM cross-sectional profiles of the first region −1 of the sample 24 of the second example. Specifically, FIG. 8B is the cross-sectional profile obtained by cutting the measurement result of the first region −1 along the white line (first direction) in FIG. 8A. Furthermore, FIG. 9B is the cross-sectional profile obtained by cutting the measurement result of the first region −1 along the white line (second direction orthogonal to the first direction) in FIG. 9A. FIG. 10A and FIG. 11A are AFM photographs of the second region of the sample 24 of the second example. FIG. 10B and FIG. 11B are AFM cross-sectional profiles of the second region of the sample 24 of the second example. Specifically, FIG. 10B is the cross-sectional profile obtained by cutting the measurement result of the second region along the white line (first direction) in FIG. 10A. Furthermore, FIG. 11B is the cross-sectional profile obtained by cutting the measurement result of the second region along the white line (second direction orthogonal to the first direction) in FIG. 11A. FIG. 12A and FIG. 13A are AFM photographs of the third region of the sample 24 of the second example. FIG. 12B and FIG. 13B are AFM cross-sectional profiles of the third region of the sample 24 of the second example. Specifically, FIG. 12B is the cross-sectional profile obtained by cutting the measurement result of the third region along the white line (first direction) in FIG. 12A. Furthermore, FIG. 13B is the cross-sectional profile obtained by cutting the measurement result of the third along the white line (second direction orthogonal to the first direction) in FIG. 13A.

The height of the element corresponding to the first convex portion in the blue crystal part corresponds to the height of each peak as illustrated in FIG. 8B, and the length of the element corresponding to the first convex portion corresponds to a distance between the peaks. That is, the height of each peak corresponds to the height H of the first convex portion 12 of FIG. 1, and a length between the peaks corresponds to the interval I of the first convex portion 12. The height of each peak was in the range of several ten nanometers (10 nm or more and 100 nm or less), and the distance between the peaks was regularly arranged in the range of several hundred nanometers (100 nm or more and 1000 nm or less) (from the cross-sectional profile obtained by cutting the measurement result of in the first direction). The height of the blue crystal part is mostly included in the range of 40 nm or more and 70 nm or less and the pitch is mostly included in the range of 300 nm or more and 500 nm or less. It was presumed that the irregular structure and the pitch interval were factors that strongly reflect a blue color. The pitch (300 nm to 500 nm) of the irregular structure and the wavelength of blue light are almost the same. According to the Huygens' principle, light with a longer wavelength than the pitch does not cause diffraction, which is considered to be based on the principle of a diffraction grating in which blue reflection is relatively strong. Furthermore, since the width of one irregularity is smaller than the wavelength of light, diffraction spread occurs, so that it looks blue in a wide angle range. Moreover, since the arrangement of the irregularities includes randomness in both the height direction and the planar direction, it is considered that iridescent interference such as a general diffraction grating due to light interference between different irregularities is prevented.

Furthermore, the cross-sectional profile obtained by cutting the measurement result in the second direction indicates the height of the elements and the interval length corresponding to the first convex structural body in the blue crystal part, the height of the elements corresponding to the first convex structural body including the first convex portion corresponds to the height of the peak of FIG. 9B, and the length of the elements corresponds to the distance between the peaks. That is, the height of each peak corresponds to the height H' of the first convex structural body 11 including the first convex portion of FIG. 1, and the length between the peaks corresponds to the interval I' of the first convex structural body 11. As illustrated in FIG. 9B, the height of the elements corresponding to the height of the first convex structural body including the first convex portion is higher than the height of the elements corresponding to the first convex portion illustrated in FIG. 8B, and the pitches (lengths of the elements corresponding to the intervals between the first convex structural bodies) are arranged at intervals wider than the intervals between the elements corresponding to the first convex portions. As illustrated in FIG. 9B, the length of the element is mostly included in the range of 650 nm or more and 780 nm or less, and the height of the element is mostly included in the range of 75 nm or more and 120 nm or less.

As illustrated in FIG. 10B, in the white crystal part, irregularities having the height of 5 to 13 nm of the second convex portion (height of the element) were regularly arranged at a pitch of 100 to 200 nm (length of the element that is the second convex portion). The irregular structure having a pitch of 100 to 200 nm is shorter than visible light (380 nm to 780 nm). Therefore, no diffraction occurs in an entire visible light region and diffused reflection occurs. Due to the diffused reflection, a higher reflection than a reflectance based on an intrinsic refractive index and an extinction coefficient of titanium is obtained, and it looks white and shiny. It is presumed that the high reflectance of white is obtained due to the diffused reflection in the entire visible light region.

Note that, from FIG. 11B, in the white crystal part, the second convex structural bodies adjacent in the second direction are arranged at an interval I of several hundred nanometers or more and several thousand nanometers or less (mostly, 820 nm or more and 1100 nm or less). In the second convex structural bodies, a height including the height of the second convex portion is several ten nanometers or more and several hundred nanometers or less (mostly, 75 nm or more and 120 nm or less).

It is considered that the black part has a substantially flat structure even though any regions are measured, does not cause diffraction or scattering due to light, and has a reflection color that titanium originally has. It is considered that the black crystal part was observed in black because the blue crystal part and the white crystal part described above reflect light brighter than the original reflection color of titanium.

As described above, the blue reflection and white reflection are observed mainly due to the formation of the aforementioned fine structure on the titanium surface. The fine structure is generated by controlling the first arrival temperature, the second temperature increasing time, the second arrival temperature, the second holding time, and the like.

Figure 14:
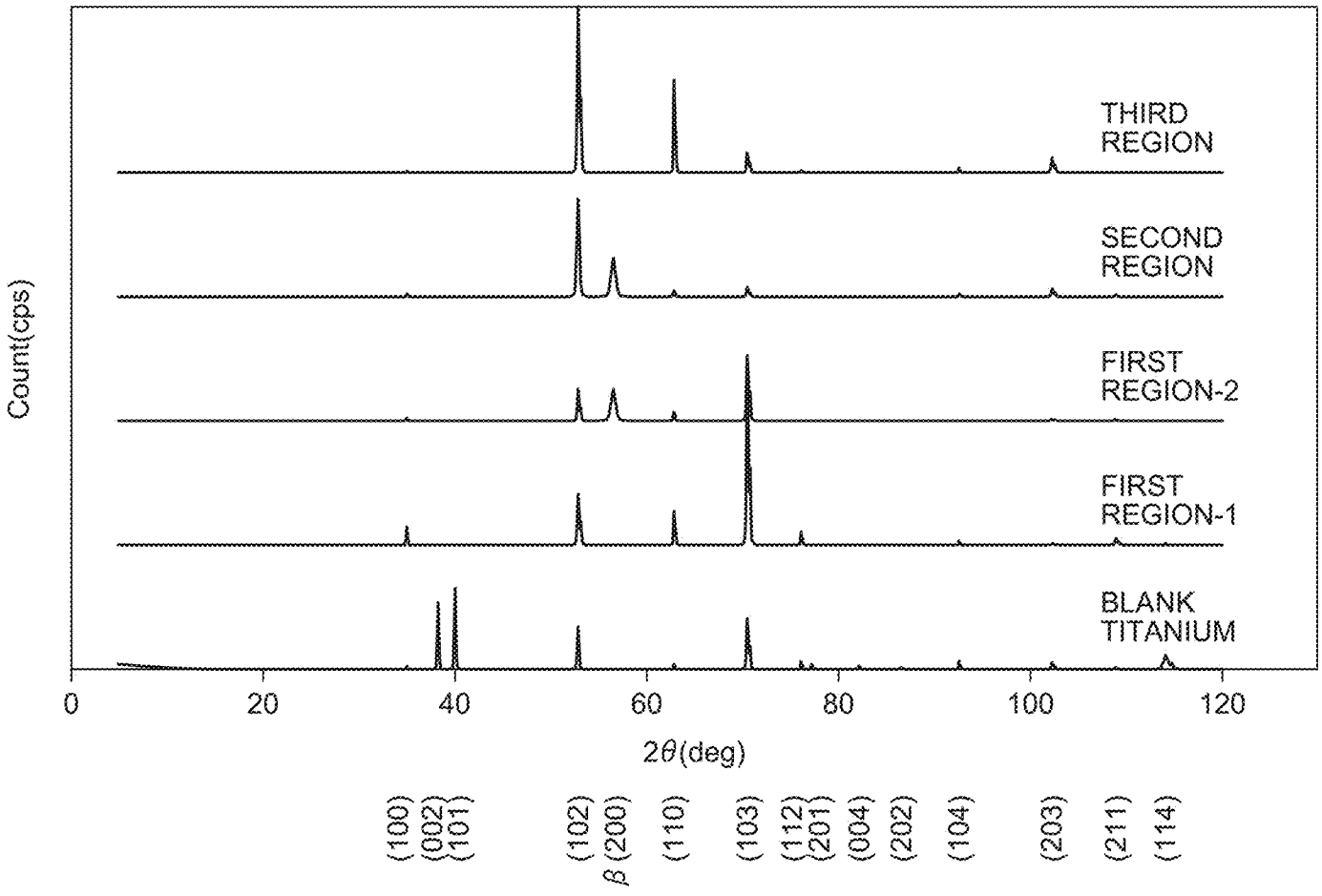
FIG. 14 is an XRD spectrum of the sample 24 of the second example.

Regarding the sample 24, the crystal orientation of each of the blue crystal part (first region −1, first region −2, see FIG. 6D), the white crystal part (second region), and the black crystal part (third region) was examined by X-ray diffraction measurement. That is, FIG. 14 is an XRD spectrum of the sample 24 of the second example. FIG. 14 also illustrates the measurement result of blank titanium before heat treatment for comparison.

The blue crystal part (first region −1) was preferentially oriented in the order of the (103) plane, the (102) plane, the (110) plane, and the (100) plane belonging to the α phase, which is a hexagonal close-packed crystal. The whitish blue crystal part (first region −2) was preferentially oriented in the order of the (103) plane and the (102) plane belonging to the α phase, which is a hexagonal close-packed crystal, and the (200) plane belonging to the β phase, which is a body-centered cubic crystal. The white crystal part (second region) was preferentially oriented in the order of the (102) plane belonging to the α phase, the (200) plane belonging to the β phase, and the (103) plane and the (110) plane belonging to the α phase, and was very similar to the orientation pattern of the blue crystal part. The black crystal part (third region) was preferentially oriented in the order of the (102) plane, the (110) plane, the (103) plane, and the (203) plane belonging to the α phase. It is considered that due to the crystal orientation, crystals exhibiting a blue color are obtained when temperature is increased from the α phase of pure titanium, and blue crystals change to white crystals and block crystals by increasing the holding time or the arrival temperature.

Third Example

In the manufacturing of samples 51 to 56, first, the pure titanium plate material, which is the #800 polished raw material titanium member of JIS class 2, was set in the vacuum heat treatment furnace and air in the furnace was evacuated to 2.0 E-4 Pa. Then, the following heat treatment conditions were performed. That is, in the manufacturing of the samples 51 to 56, a heat treatment pattern in which temperature increasing and temperature decreasing are repeated was used. Next, cooling was performed up to 150° C.

Sample 51: Temperature increasing from room temperature to 850° C. over 85 minutes→temperature increasing from 850° C. to 950° C. over 1 hour→temperature decreasing from 950° C. to 900° C. over 0.5 hours→temperature increasing from 900° C. to 1000° C. over 1 hour→temperature decreasing from 1000° C. to 950° C. over 0.5 hours→temperature increasing from 950° C. to 1050° C. over 1 hour→temperature decreasing from 1050° C. to 1000° C. over 0.5 hours→temperature increasing from 1000° C. to 1100° C. over 1 hour.

Sample 52: Temperature increasing from room temperature to 850° C. over 85 minutes→temperature increasing from 850° C. to 950° C. over 1 hour→temperature decreasing from 950° C. to 900° C. over 0.5 hours→temperature increasing from 900° C. to 1000° C. over 1 hour→temperature decreasing from 1000° C. to 950° C. over 0.5 hours→temperature increasing from 950° C. to 1050° C. over 1 hour→temperature decreasing from 1050° C. to 1000° C. over 0.5 hours→temperature increasing from 1000° C. to 1100° C. over 1 hour→temperature decreasing from 1100° C. to 1050° C. over 0.5 hours→holding at 1050° C. for 0.5 hours.

Sample 53: Temperature increasing from room temperature to 850° C. over 85 minutes→temperature increasing from 850° C. to 950° C. over 1 hour→temperature decreasing from 950° C. to 900° C. over 0.5 hours→temperature increasing from 900° C. to 1000° C. over 1 hour→temperature decreasing from 1000° C. to 950° C. over 0.5 hours→temperature increasing from 950° C. to 1050° C. over 1 hour→temperature decreasing from 1050° C. to 1000° C. over 0.5 hours→temperature increasing from 1000° C. to 1100° C. over 1 hour→temperature decreasing from 1100° C. to 1050° C. over 0.5 hours→holding at 1050° C. for 1 hour.

Sample 54: Temperature increasing from room temperature to 850° C. over 85 minutes→temperature increasing from 850° C. to 950° C. over 1 hour→temperature decreasing from 950° C. to 850° C. over 0.5 hours→temperature increasing from 850° C. to 1000° C. over 1 hour→temperature decreasing from 1000° C. to 850° C. over 0.5 hours→temperature increasing from 850° C. to 1050° C. over 1 hour→temperature decreasing from 1050° C. to 850° C. over 0.5 hours→temperature increasing from 850° C. to 1100° C. over 1 hour.

Sample 55: Temperature increasing from room temperature to 850° C. over 85 minutes→temperature increasing from 850° C. to 950° C. over 1 hour→temperature decreasing from 950° C. to 900° C. over 0.5 hours→temperature increasing from 900° C. to 1000° C. over 1 hour→temperature decreasing from 1000° C. to 950° C. over 0.5 hours→temperature increasing from 950° C. to 1050° C. over 1 hour→holding at 1050° C. for 1 hour.

Sample 56: Temperature increasing from room temperature to 850° C. over 85 minutes→temperature increasing from 850° C. to 950° C. over 1 hour→temperature decreasing from 950° C. to 900° C. over 0.5 hours→temperature increasing from 900° C. to 1000° C. over 1 hour→temperature decreasing from 1000° C. to 950° C. over 0.5 hours→temperature increasing from 950° C. to 1050° C. over 1 hour→holding at 1050° C. for 0.5 hours.

Figure 15:
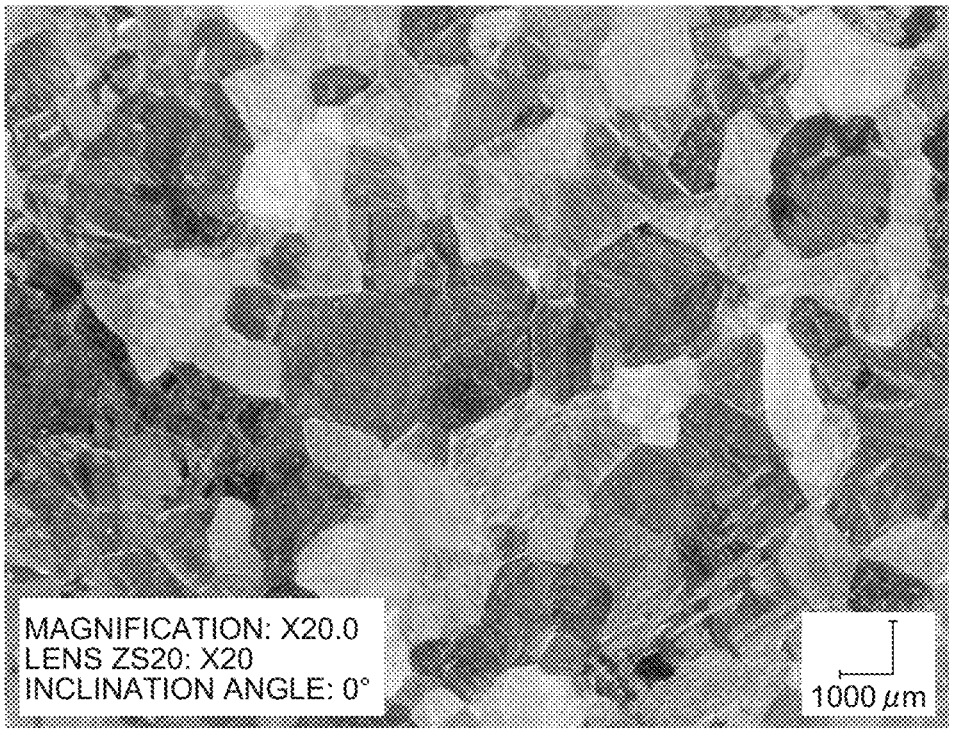
FIG. 15 is a micrograph of sample 51 of a third example.

Representative photographs are illustrated in FIG. 15. That is, FIG. 15 is a micrograph of the sample 51 of the third example.

Table 3 below illustrates the evaluation result of the samples 51 to 56.

TABLE 3

| Sample No | Region size (μm) | Area ratio(%) of first region | Area ratio(%) of second region | Total area ratio(%) of first and second regions | Evaluation result |
|---|---|---|---|---|---|
| 51 | 1765 | 40 | 4 | 44 | 5 |
| 52 | 2283 | 15 | 14 | 29 | 5 |
| 53 | 1877 | 8 | 20 | 28 | 5 |
| 54 | 1703 | 50 | 15 | 65 | 5 |
| 55 | 1748 | 22 | 9 | 31 | 5 |
| 56 | 1881 | 17 | 14 | 31 | 5 |

The blue crystals were increased dramatically by repeating temperature increasing in a jagged manner. The blue crystals are considered to be formed by a phase transition occurring when temperature increases. Therefore, it is considered that the crystal amount further increases under the condition that temperature is not constant and constantly varies.

First Reference Example

In the manufacturing of samples 57 and 58, first, the pure titanium plate material, which is the #800 polished raw material titanium member of JIS class 2, was set in the vacuum heat treatment furnace and air in the furnace was evacuated to 2.0 E-4 Pa. Then, the following heat treatment conditions were performed. Next, cooling was performed up to 150° C.

Sample 57: Temperature increasing from room temperature to 200° C.→temperature increasing from 200° C. to 1000° C. over 0.5 hours→holding at 1000° C. for 1 hour→temperature decreasing from 1000° C. to 500° C. over 0.5 hours→holding at 500° C. for 16 hours.

Sample 58: Temperature increasing from room temperature to 200° C.→temperature increasing from 200° C. to 1200° C. over 0.5 hours→holding at 1200° C. for 2 hours→temperature decreasing from 1200° C. to 500° C. over 0.7→holding at 500° C. for 16 hours.

Table 4 below illustrates the evaluation result of the samples 57 and 58.

TABLE 4

| Sample No | Region size (μm) | Area ratio(%) of first region | Area ratio(%) of second region | Total area ratio(%) of first and second regions | Evaluation result |
|---|---|---|---|---|---|
| 57 | 1108 | 6 | 6 | 12 | 2 |
| 58 | — | 0 | 0 | 0 | 0 |

In the sample 57, both blue crystals and white crystals were confirmed and the crystal size was as small as 1108 μm and the crystal amount was also small. The heat treatment conditions were close to those of the sample 7 of the first example and the result was almost the same. It is considered that the holding at 500° C. has almost no effect on an increase in the crystal amount.

In the sample 58, since the temperature was increased to 1200° C., both blue crystals and white crystals disappeared completely. The heat treatment conditions were close to those of the sample 12 of the second example and the result was almost the same. It is considered that the holding at 500° C. has almost no effect on an increase in the crystal amount.

<Analysis Method and Result>

[Reflectance Measurement]

Figure 16:
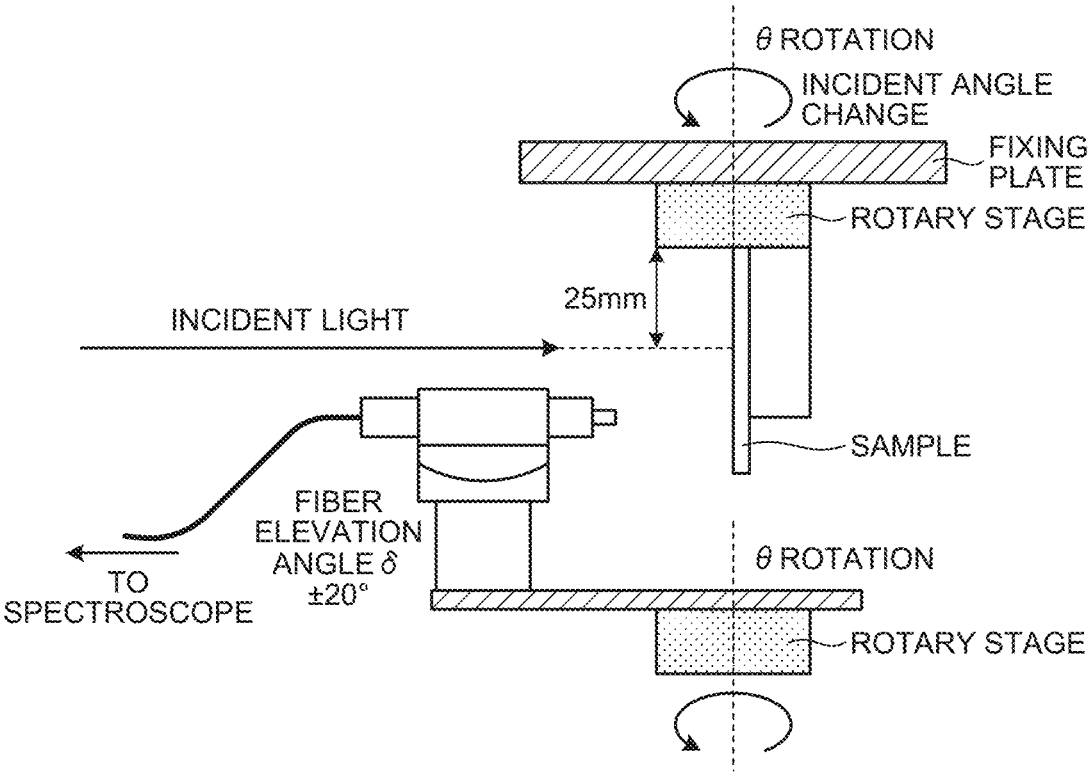
FIG. 16 is a diagram illustrating a minute part light intensity measuring instrument used in reflectance measurement.

The reflectance measurement of the first region (blue crystal part) was performed using a minute part light intensity measuring instrument used for reflectance measurement illustrated in FIG. 16. The minute part light intensity measuring instrument has a rotary stage that holds a sample and is provided on a fixing plate, and a rotary stage that holds a fiber. Light reflected from the sample is guided to an integrating sphere and a spectroscope via the fiber. In the present measurement, incident light from a light source that is narrowed down to ϕ1 mm was emitted to the sample (blue crystal part) by using a lens, light reflected from the sample was integrated by the integrating sphere, and the intensity for each wavelength was measured by the spectroscope. Next, a standard white plate was measured by the same method, and the light intensity of the blue crystal part was divided by the light intensity obtained by the standard white plate to obtain reflectance.

Figure 17:
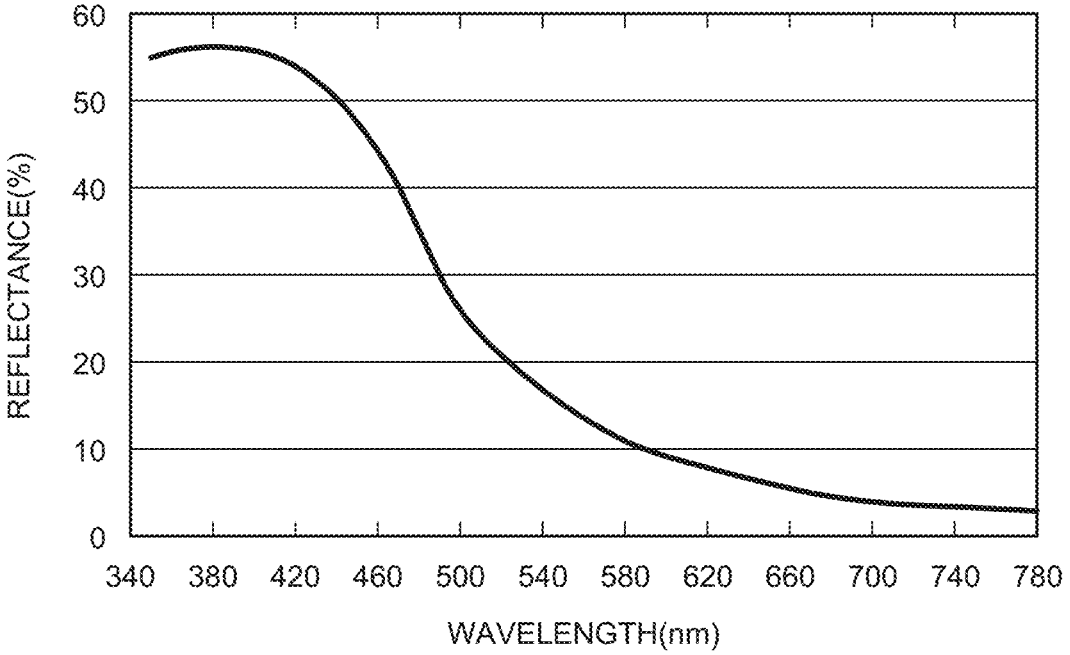
FIG. 17 is a diagram illustrating the reflectance measurement result for the first region of the sample 24 of the second example.

FIG. 17 is a diagram illustrating the reflectance measurement result for the first region of the sample 24 of the second example. It is understood that 340 to 500 nm exhibiting a blue color are strongly reflected by the obtained reflectance. Furthermore, when the color of the first region (blue crystal part) was measured by the VHX-5000 microscope manufactured by Keyence, values of R103, G122, and B236 were obtained.

Fourth Example

As a vacuum heat treatment device, a device, which is provided with a diffusion pump capable of evacuating air to a high vacuum of $1.0\times10^{-5}$ Pa or less and can heat samples with a heater therein, was used.

In the manufacturing of sample 59, first, a titanium plate material, having 15-3-3-3β titanium (Ti-15V-3Cr-3Sn-3Al alloy) of a raw material titanium member that is a #800 polished β alloy, was set in the furnace of the vacuum heat treatment device and air in the furnace was evacuated to 2.0 E-4 Pa. Then, the following heat treatment conditions for repeating temperature increasing and temperature decreasing were performed. Note that the heat treatment conditions are the same as those of the sample 55. Next, cooling was performed up to 150° C. By so doing, the sample 59 was obtained.

Sample 59: Temperature increasing from room temperature to 850° C. over 85 minutes→temperature increasing from 850° C. to 950° C. over 1 hour→temperature decreasing from 950° C. to 900° C. over 0.5 hours→temperature increasing from 900° C. to 1000° C. over 1 hour→temperature decreasing from 1000° C. to 950° C. over 0.5 hours→temperature increasing from 950° C. to 1050° C. over 1 hour→holding at 1050° C. for 1 hour.

In the manufacturing of sample 60, the sample 60 was obtained in the same manner as the sample 59, except that a titanium plate material, having DAT51β titanium (Ti-22V-4Al alloy) that is a β alloy, was used. Furthermore, in the manufacturing of sample 61, the sample 61 was obtained in the same manner as the sample 59, except that a titanium plate material, having SP-700α+β titanium (Ti-4.5Al-3V-2Mo-2Fe alloy) that is an α+β alloy, was used.

Figure 18:
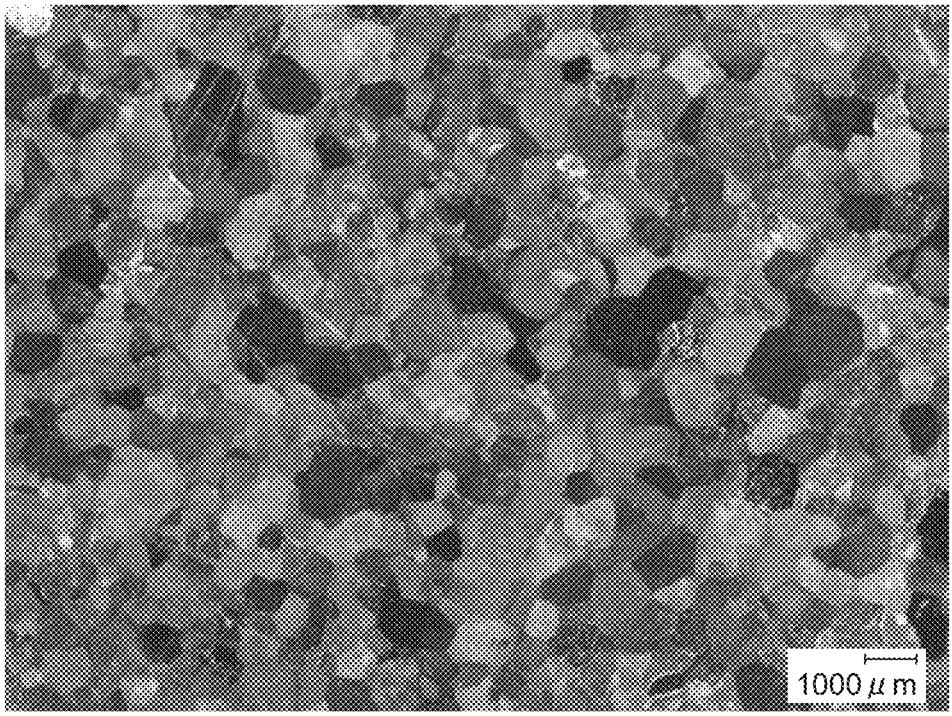
FIG. 18 is a micrograph of sample 59 of a fourth example.
Figure 19:
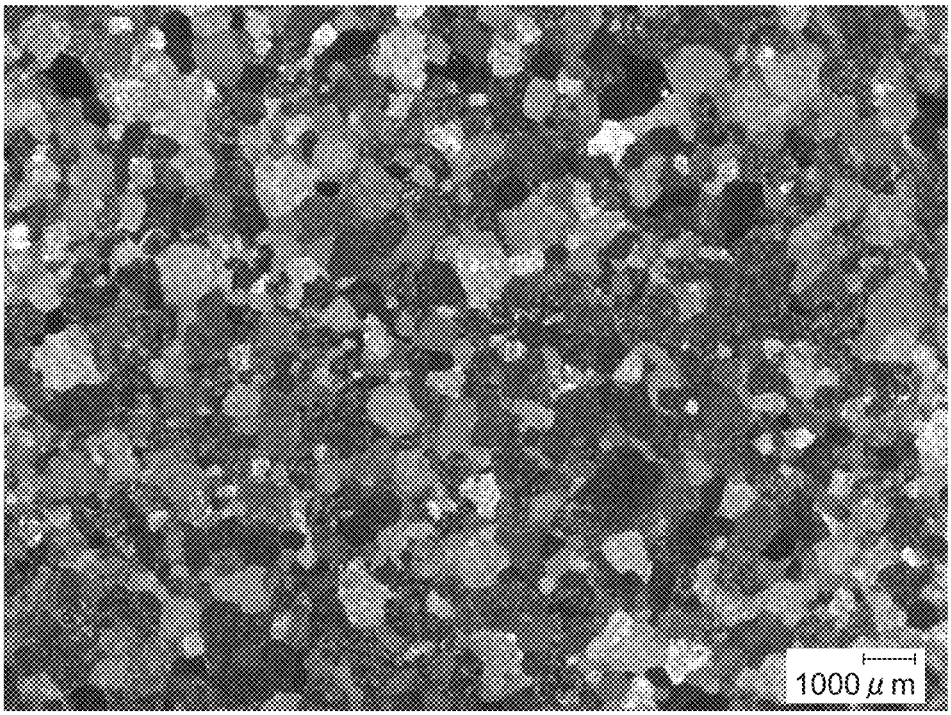
FIG. 19 is a micrograph of sample 60 of the fourth example.
Figure 20:
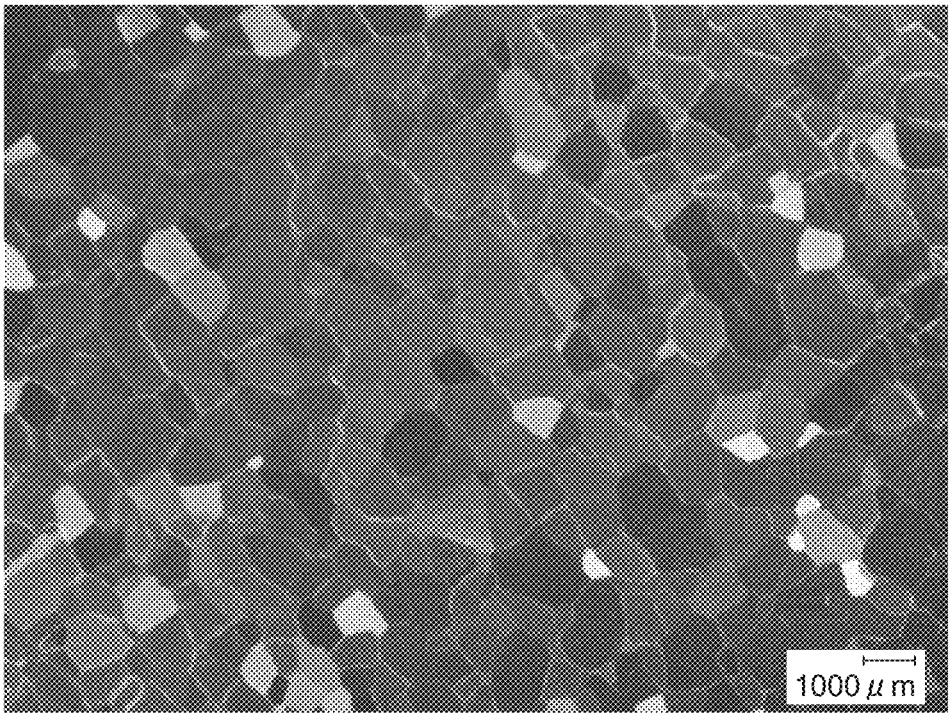
FIG. 20 is a micrograph of sample 61 of the fourth example.

FIG. 18 is a micrograph of the sample 59 of the fourth example. FIG. 19 is a micrograph of the sample 60 of the fourth example. FIG. 20 is a micrograph of the sample 61 of the fourth example. Blue crystals were obtained even in any of the alloys and there were more blue crystals than pure titanium. The crystal size was small as a whole and did not reach 1500 μm, but the ratio of the blue crystals was very high. Moreover, in the case of a titanium member of pure titanium that has a titanium content of 99 mass % or more, a wrinkle-like crystal interface is generated on the entire surface, but in the case of a titanium member of a β alloy or an α+β alloy, such wrinkles at the crystal interface were hardly generated, blue was formed in a polished mirror state, and more beautiful blue crystals were exhibited. The reason why such wrinkles at the crystal interface are suppressed is unknown, but it is presumed that, the crystal interface due to sliding occurring during the transition from the α phase to the β phase, such as pure titanium, was decreased because the β alloy or the α+β alloy originally has the β phase. Alternatively, it is considered that the presence of V and Mo, which are β-phase stable metals, may suppress deformability at high temperature. Table 5 below illustrates the crystal size, the crystal ratio, and the evaluation result.

TABLE 5

| Sample No | Region size (μm) | Area ratio(%) of first region | Area ratio(%) of second region | Total area ratio(%) of first and second regions | Evaluation result |
|---|---|---|---|---|---|
| 59 | 1120 | 41 | 2 | 43 | 2 |
| 60 | 987 | 28 | 4 | 32 | 1 |
| 61 | 1350 | 52 | 3 | 55 | 2 |

Fifth Example

Titanium of the β alloy or the α+β alloy generally has a lower phase transition temperature than pure titanium due to the influence of additive elements. For example, the phase transition temperature of 15-3-3-3β titanium of the β alloy is 760° C. In this regard, the following heat treatment conditions, in which the temperature T1 in the heat treatment step was set to 730° C. and the arrival temperature was changed to 1100° C., were performed. That is, samples 62 to 64 were obtained in the same manner as the samples 59 to 61 except that the following heat treatment conditions were performed.

Samples 62 to 64: Temperature increasing from room temperature to 730° C. over 85 minutes→Temperature increasing from 730° C. to 850° C. over 1 hour→temperature decreasing from 850° C. to 800° C. over 0.5 hours→temperature increasing from 800° C. to 900° C. over 1 hour→temperature decreasing from 900° C. to 850° C. over 0.5 hours→temperature increasing from 850° C. to 950° C. over 1 hour→temperature decreasing from 950° C. to 900° C. over 0.5 hours→temperature increasing from 900° C. to 1000° C. over 1 hour→temperature decreasing from 1000° C. to 950° C. over 0.5 hours→temperature increasing from 950° C. to 1050° C. over 1 hour→temperature decreasing from 1050° C. to 1000° C. over 0.5 hours→temperature increasing from 1000° C. to 1100° C. over 1 hour.

Figure 21:
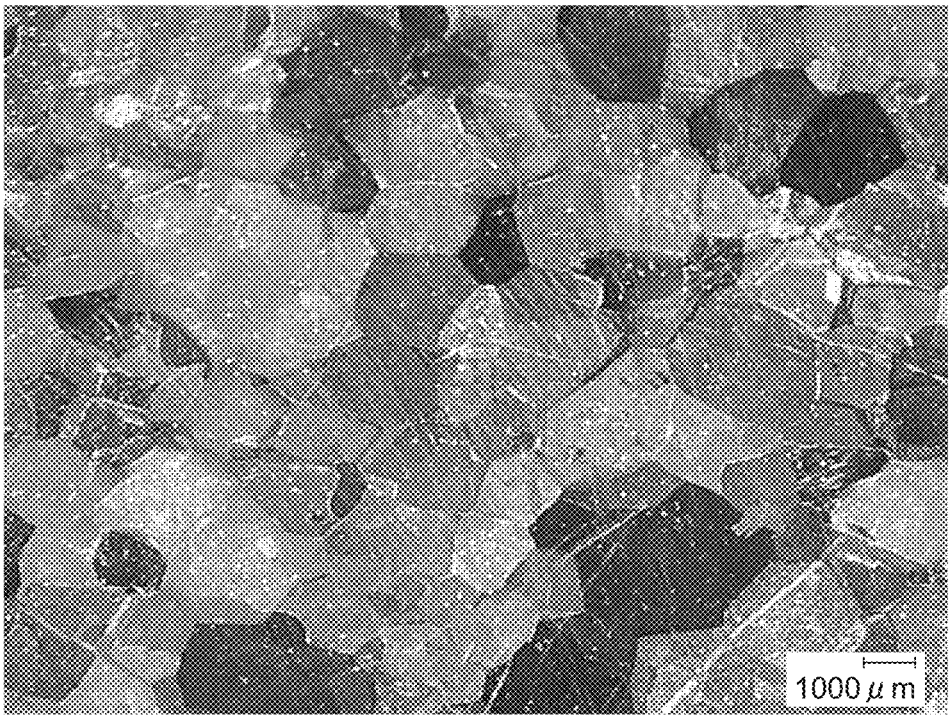
FIG. 21 is a micrograph of sample 62 of a fifth example.
Figure 22:
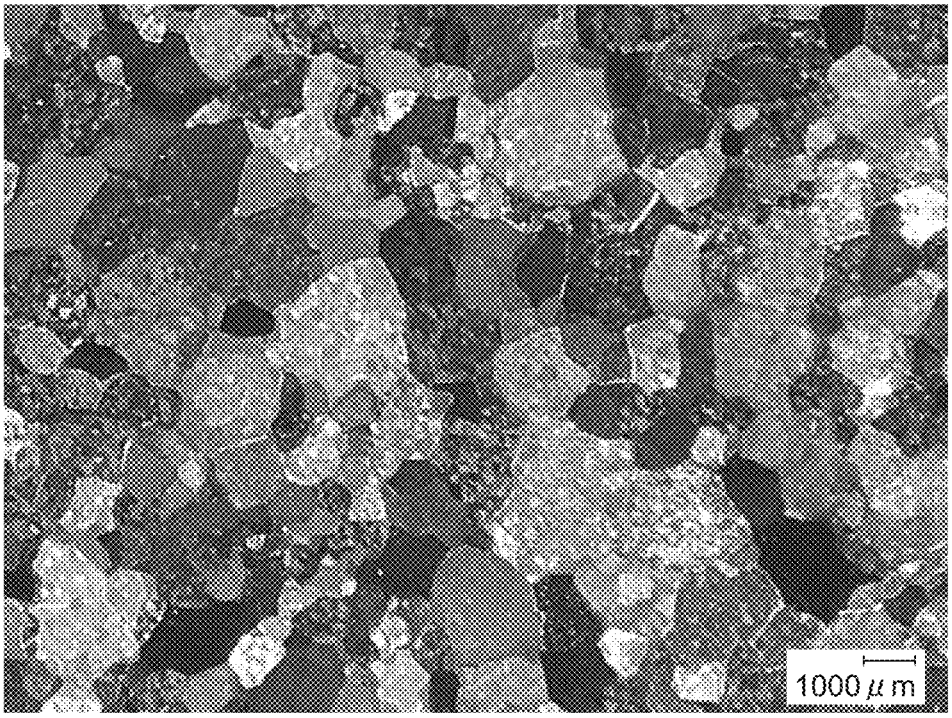
FIG. 22 is a micrograph of sample 63 of the fifth example.
Figure 23:
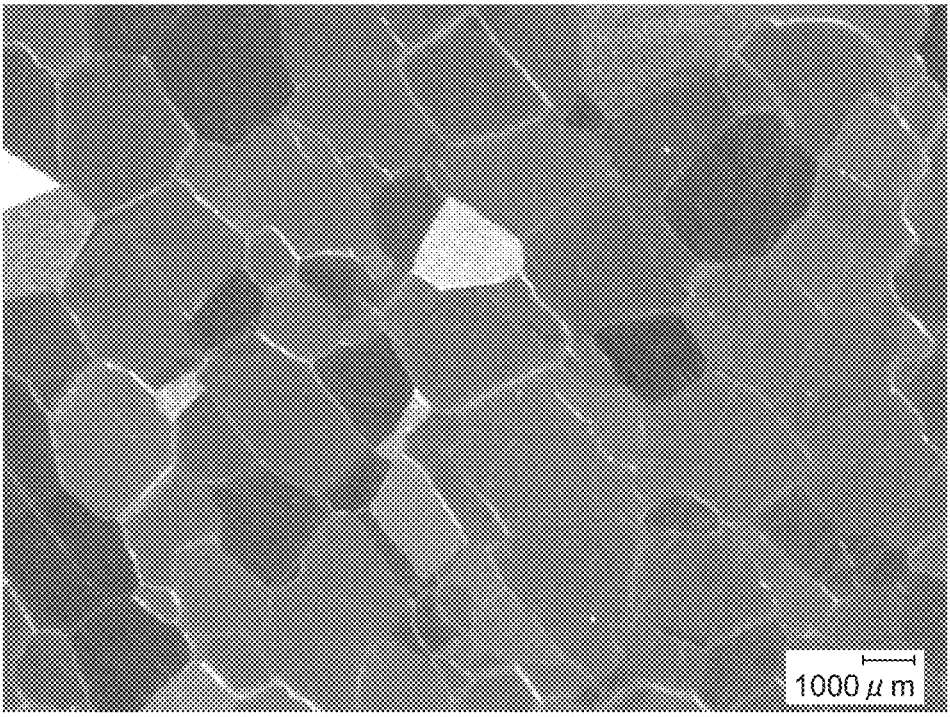
FIG. 23 is a micrograph of sample 64 of the fifth example.

FIG. 21 is a micrograph of the sample 62 of the fifth example. FIG. 22 is a micrograph of the sample 63 of the fifth example. FIG. 23 is a micrograph of the sample 64 of the fifth example. Compared with the heat treatment conditions of the samples 59 to 61, the crystal size was obviously increased and the blue crystal amount was also increased. There were few wrinkles on the crystal surface, and the blue crystals exhibited a more beautiful surface than pure titanium. Table 6 below illustrates the crystal surface, the crystal ratio, and the evaluation result.

TABLE 6

| Sample No | Region size (μm) | Area ratio(%) of first region | Area ratio(%) of second region | Total area ratio(%) of first and second regions | Evaluation result |
|---|---|---|---|---|---|
| 62 | 1612 | 45 | 1 | 46 | 5 |
| 63 | 1350 | 31 | 4 | 35 | 2 |
| 64 | 1742 | 62 | 1 | 63 | 5 |

Figure 24:
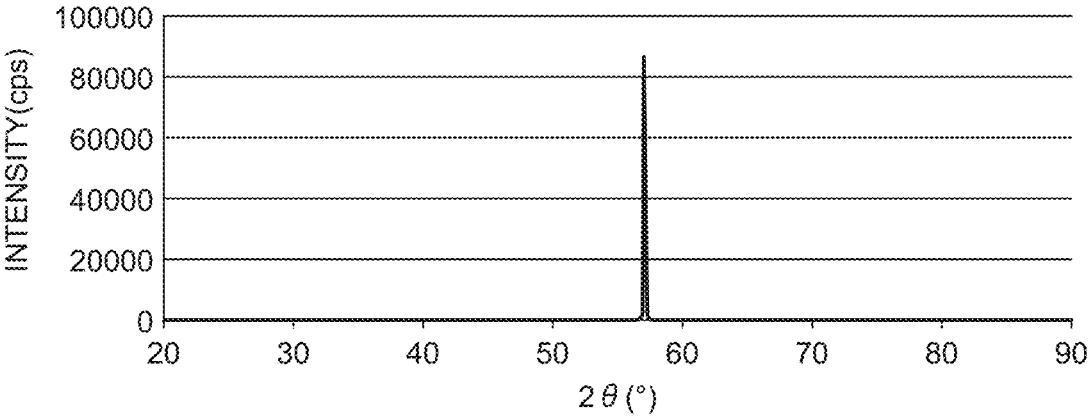
FIG. 24 is an XRD spectrum of the sample 62 of the fifth example.
Figure 25:
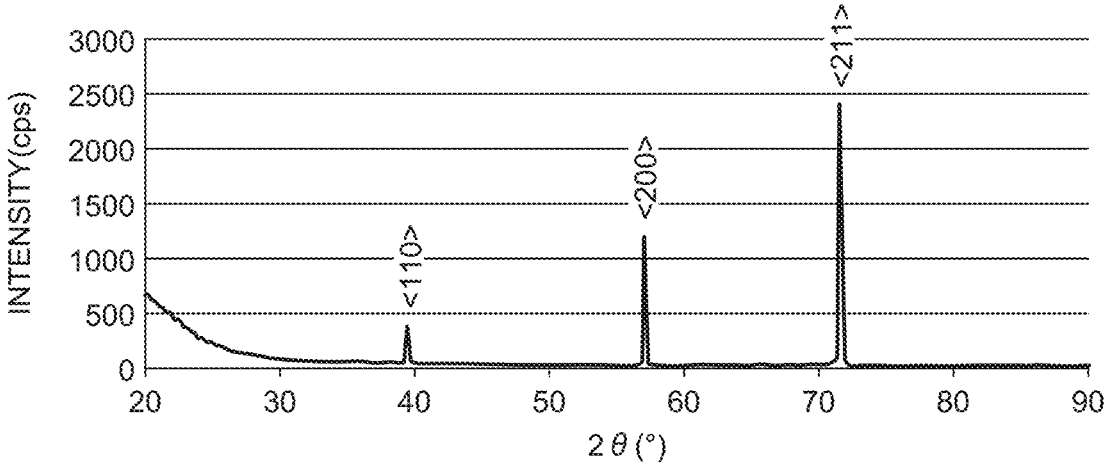
FIG. 25 is an XRD spectrum of raw material titanium (a titanium plate material including 15-3-3-3β titanium) of the sample 62 of the fifth example.

FIG. 24 is an XRD spectrum of the sample 62 of the fifth example. FIG. 25 is an XRD spectrum of a raw material titanium member (titanium plate material including 15-3-3-3β titanium) of the β alloy of the sample 62 of the fifth example. Before the heat treatment, the β titanium has a crystal structure oriented in the <110> plane near 39°, the <200> plane near 56°, and the <211> plane near 70°. On the other hand, after the heat treatment, the β titanium has a crystal structure preferentially oriented only in the <200> plane near 56°. It is considered that such a structure preferentially oriented in the <200> plane is a crystal pattern indicating the blue crystal structure.

From the above results, it has been found that it is possible to generate crystal patterns even other than pure titanium.

Reference Signs List

10 first region
11 first convex structural body
12 first convex portion
20 second region
21 second convex structural body
22 second convex portion

The invention claimed is:

1. A titanium member comprising:

a first region where a plurality of first convex structural bodies extending in a first direction are arranged on a surface of the titanium member in a second direction orthogonal to the first direction, wherein each first convex structural body has first convex portions arranged on an upper surface of the first convex structural body at an interval within a range of 300 nm to 500 nm along the first direction, wherein a height of each first convex portion above the first convex structural body is within a range of 40 nm to 70 nm, and in the first region, a difference between an R value and a G value is within 30, and a B value is larger than the R value by 70 or more and is larger than the G value by 70 or more, wherein each of the R value, the G value, and the B value is an integer of 0 or more and 255 or less in red, green and blue (RGB) measurement values.

2. The titanium member according to claim 1, wherein a titanium content of the titanium member is 99 mass % or more.

3. The titanium member according to claim 1, wherein the titanium member includes a β alloy or an α+β alloy.

4. The titanium member according to claim 1, wherein the first convex structural bodies adjacent in the second direction are arranged at an interval wider than the interval at which the first convex portions are arranged, and wherein in the first convex structural bodies, a height of the first convex structural bodies and the first convex portions from bottom of the first convex structural bodies is higher than the height of the first convex portion.

5. The titanium member according to claim 2, wherein the first convex structural bodies adjacent in the second direction are arranged at an interval wider than the interval at which the first convex portions are arranged, and wherein in the first convex structural bodies, a height of the first convex structural bodies and the first convex portions from bottom of the first convex structural bodies is higher than the height of the first convex portion.

6. The titanium member according to claim 3, wherein the first convex structural bodies adjacent in the second direction are arranged at an interval wider than the interval at which the first convex portions are arranged, and wherein in the first convex structural bodies, a height of the first convex structural bodies and the first convex portions from bottom of the first convex structural bodies is higher than the height of the first convex portion.

7. The titanium member according to claim 2, wherein the first region includes a crystal structure preferentially oriented in (102), (110), and (103) planes belonging to an α phase, which is a hexagonal close-packed crystal, or includes the crystal structure preferentially oriented in the (102), (110), and (103) planes belonging to the α phase, which is a hexagonal close-packed crystal, and a crystal structure preferentially oriented in a (200) plane belonging to a β phase, which is a body-centered cubic crystal.

8. The titanium member according to claim 1, wherein a size of the first region is 100 μm or more and 2500 μtm or less wherein the size is two items of a longitudinal direction and a short direction and an average value of the two items are obtained as the size.

9. The titanium member according to claim 1, further comprising:

a second region where a plurality of second convex structural bodies extending in the first direction are arranged on the surface of the titanium member in the second direction orthogonal to the first direction, wherein each second convex structural body has second convex portions arranged on an upper surface of the second convex structural body at an interval that is narrower than the interval at which the first convex portions are arranged, along the first direction, and wherein a height of each second convex portion above the second convex structural body is lower than the height of the first convex portion.

10. A decorative article comprising the titanium member according to claim 1.

11. A method for manufacturing the titanium member of claim 1:

a first heating step of heating a raw material titanium member under reduced pressure by increasing temperature from room temperature to temperature T1 of 730° C. or more to 950° C. or less;

a second heating step of heating the raw material titanium member that has been subjected to the first heating step, under reduced pressure by increasing temperature from the temperature T1 to temperature T2 of 900° C. or more to 1150° C. or less that is higher than the temperature T1, over 0.5 hours or more and 8 hours or less; and a cooling step of cooling the raw material titanium member that has been subjected to the second heating step by decreasing temperature from the temperature T2 to temperature lower than the temperature T2 and obtaining the titanium member.

12. The method for manufacturing the titanium member according to claim 11, wherein the titanium member has a titanium content of 99 mass % or more and the raw material titanium member has a titanium content of 99 mass % or more.

13. The method for manufacturing the titanium member according to claim 11, wherein the titanium member includes a β alloy or an α+β alloy and the raw material titanium member includes a β alloy or an α+β alloy.

14. The method for manufacturing the titanium member according to claim 11, further comprising:

a first holding step of holding the raw material titanium member that has been subjected to the first heating step, under reduced pressure at the temperature T1 for 0.5 hours or more and 3 hours or less, and in the second heating step, the raw material titanium member that has been subjected to the first holding step is heated.

15. The method for manufacturing the titanium member according to claim 11, further comprising:

a second holding step of holding the raw material titanium member that has been subjected to the second heating step, under reduced pressure at the temperature T2 for 0.5 hours or more and 6 hours or less, and in the cooling step, the raw material titanium member that has been subjected to the second holding step is cooled to obtain the titanium member.

16. The method for manufacturing the titanium member according to claim 11, wherein, in the second heating step, the raw material titanium member is heated by repeatedly increasing and decreasing temperature.

17. A method for manufacturing the titanium member of claim 2, the method comprising:

a first heating step of heating a raw material titanium member that has a titanium content of 99 mass % or more, under reduced pressure by increasing temperature from room temperature to temperature T of 900° C. or more to 1100° C. or less;

a first holding step of holding the raw material titanium member that has been subjected to the first heating step, under reduced pressure at the temperature T for 1 hour or more and 8 hours or less; and a cooling step of cooling the raw material titanium member that has been subjected to the first holding step by decreasing temperature from the temperature T to temperature lower than the temperature T and obtaining the titanium member.

* * * * *